US012607070B2

(12) United States Patent
Pai et al.

(10) Patent No.: US 12,607,070 B2
(45) Date of Patent: Apr. 21, 2026

(54) PILOTING PULSED POWER DRILLING USING A MULTI-ACTUATOR BASED FLOATING ELECTRODE

(71) Applicant: Halliburton Energy Services, Inc., Houston, TX (US)

(72) Inventors: Nagaraja K. Pai, Houston, TX (US); Boguslaw Wiecek, Houston, TX (US); Wei Zhang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/046,255

(22) Filed: Feb. 5, 2025

(65) Prior Publication Data

US 2026/0055665 A1 Feb. 26, 2026

Related U.S. Application Data

(60) Provisional application No. 63/686,023, filed on Aug. 22, 2024.

(51) Int. Cl.
*E21B 7/15* (2006.01)
*E21B 7/06* (2006.01)

(52) U.S. Cl.
CPC ..... *E21B 7/15* (2013.01); *E21B 7/064* (2013.01)

(58) Field of Classification Search
CPC ..... E21B 7/14; E21B 7/15
See application file for complete search history.

(56) References Cited

U.S. PATENT DOCUMENTS

| | | | |
|---|---|---|---|
| 8,109,345 | B2 | 2/2012 | Jeffryes |
| 9,896,912 | B2 | 2/2018 | Tegeler et al. |
| 10,407,995 | B2 | 9/2019 | Moeny |
| 10,411,626 | B2 | 9/2019 | Rajagopalan |
| 11,078,727 | B2 | 8/2021 | Gleitman et al. |
| 11,326,399 | B2 | 5/2022 | Gleitman et al. |
| 11,680,447 | B2 | 6/2023 | Pai et al. |
| 12,104,466 | B2 | 10/2024 | Finke et al. |
| 12,123,284 | B2 | 10/2024 | Finke |
| 12,173,586 | B2 | 12/2024 | Finke et al. |
| 2006/0037779 | A1 | 2/2006 | Moeny et al. |

(Continued)

FOREIGN PATENT DOCUMENTS

| | | |
|---|---|---|
| CA | 3231158 | 5/2023 |
| CA | 3232370 | 5/2023 |

(Continued)

OTHER PUBLICATIONS

"Extended European Search Report for 22893818.9", Feb. 3, 2025, 9 pages.

(Continued)

*Primary Examiner* — David Carroll
(74) *Attorney, Agent, or Firm* — DeLizio, Peacock, Lewin and Guerra, LLP

(57) ABSTRACT

An electro-crushing drill bit is to drill a wellbore, wherein the electro-crushing drill bit comprises a bit body; a ground structure coupled to the bit body; and at least one electrode coupled to a power source and the bit body, the at least one electrode positioned within the ground structure, wherein the at least one electrode comprises, a fixed plate; and a movable plate that is movable relative to the fixed plate.

21 Claims, 11 Drawing Sheets

(56) References Cited

U.S. PATENT DOCUMENTS

| | | | | |
|---|---|---|---|---|
| 2006/0038437 | A1 | 2/2006 | Moeny | |
| 2007/0137893 | A1 | 6/2007 | Moeny et al. | |
| 2008/0245568 | A1 | 10/2008 | Jeffryes | |
| 2013/0319974 | A1* | 12/2013 | Metzner | B23H 1/04 219/69.15 |
| 2016/0326806 | A1 | 11/2016 | Lund et al. | |
| 2018/0016845 | A1 | 1/2018 | Peters | |
| 2018/0148981 | A1 | 5/2018 | Moeny | |
| 2018/0287533 | A1 | 10/2018 | Rajagopalan | |
| 2019/0040685 | A1* | 2/2019 | Moeny | E21B 10/60 |
| 2019/0316419 | A1 | 10/2019 | Bayol et al. | |
| 2020/0370375 | A1 | 11/2020 | Gleitman et al. | |
| 2021/0071489 | A1* | 3/2021 | Jamison | B01D 21/267 |
| 2021/0310311 | A1 | 10/2021 | Kronman | |
| 2021/0324683 | A1 | 10/2021 | Gleitman et al. | |
| 2022/0195806 | A1 | 6/2022 | Pai et al. | |
| 2022/0195866 | A1 | 6/2022 | Sedano | |
| 2023/0132937 | A1 | 5/2023 | Finke et al. | |
| 2023/0144439 | A1 | 5/2023 | Finke et al. | |
| 2023/0145343 | A1* | 5/2023 | Finke | H02M 1/322 175/57 |
| 2025/0034946 | A1* | 1/2025 | Pai | E21B 41/0085 |

FOREIGN PATENT DOCUMENTS

| | | |
|---|---|---|
| CN | 111119739 | 5/2020 |
| EP | 0497420 | 8/1992 |
| EP | 3508683 | 11/2020 |
| EP | 3739163 | 11/2020 |
| WO | 2014145259 | 9/2014 |
| WO | 2019245544 | 12/2019 |
| WO | 2020236189 | 11/2020 |
| WO | 2022140719 | 6/2022 |

OTHER PUBLICATIONS

"PCT Application No. PCT/US2022/079577, International Search Report and Written Opinion", Mar. 9, 2023, 11 pages.
"PCT Application No. PCT/US2022/079580, International Search Report and Written Opinion", Mar. 15, 2023, 14 pages.
"PCT Application No. PCT/US2022/079581, International Search Report and Written Opinion", Mar. 15, 2023, 12 pages.
"PCT Application No. PCT/US2022/079583, International Search Report and Written Opinion", Mar. 10, 2023, 12 pages.
"PCT Application No. PCT/US2023/071164, International Search Report and Written Opinion", Apr. 18, 2024, 13 pages.
"U.S. Appl. No. 17/982,589, Non-Final Office Action", Dec. 29, 2023, 12 pages.
"U.S. Appl. No. 17/982,739, Final Office Action", Jun. 12, 2024, 10 pages.
"U.S. Appl. No. 17/982,739, Non-Final Office Action", Dec. 14, 2023, 10 pages.
"U.S. Appl. No. 17/982,789, Non-Final Office Action", Dec. 22, 2023, 7 pages.
"U.S. Appl. No. 18/359,761 Final Office Action", Aug. 2, 2024, 10 pages.
"U.S. Appl. No. 18/359,761 Non Final Office Action", Jun. 5, 2024, 9 pages.
"U.S. Appl. No. 18/359,761 Non-Final Office Action", Nov. 6, 2024, 10 pages.
"PCT Application No. PCT/US2025/017459 International Search Report and Written Opinion", Jun. 9, 2025, 12 pages.

* cited by examiner

PILOTING PULSED POWER DRILLING USING A MULTI-ACTUATOR BASED FLOATING ELECTRODE

BACKGROUND

Electro-crushing drilling uses pulsed power technology to drill a wellbore in a rock formation. Pulsed power technology repeatedly applies a high electric potential across the electrodes of an electro-crushing drill bit, which ultimately causes the surrounding rock to fracture. The fractured rock is carried away from the bit by drilling fluid and the bit advances downhole.

BRIEF DESCRIPTION OF THE DRAWINGS

Embodiments of the disclosure may be better understood by referencing the accompanying drawings.

DESCRIPTION

Figure 1:
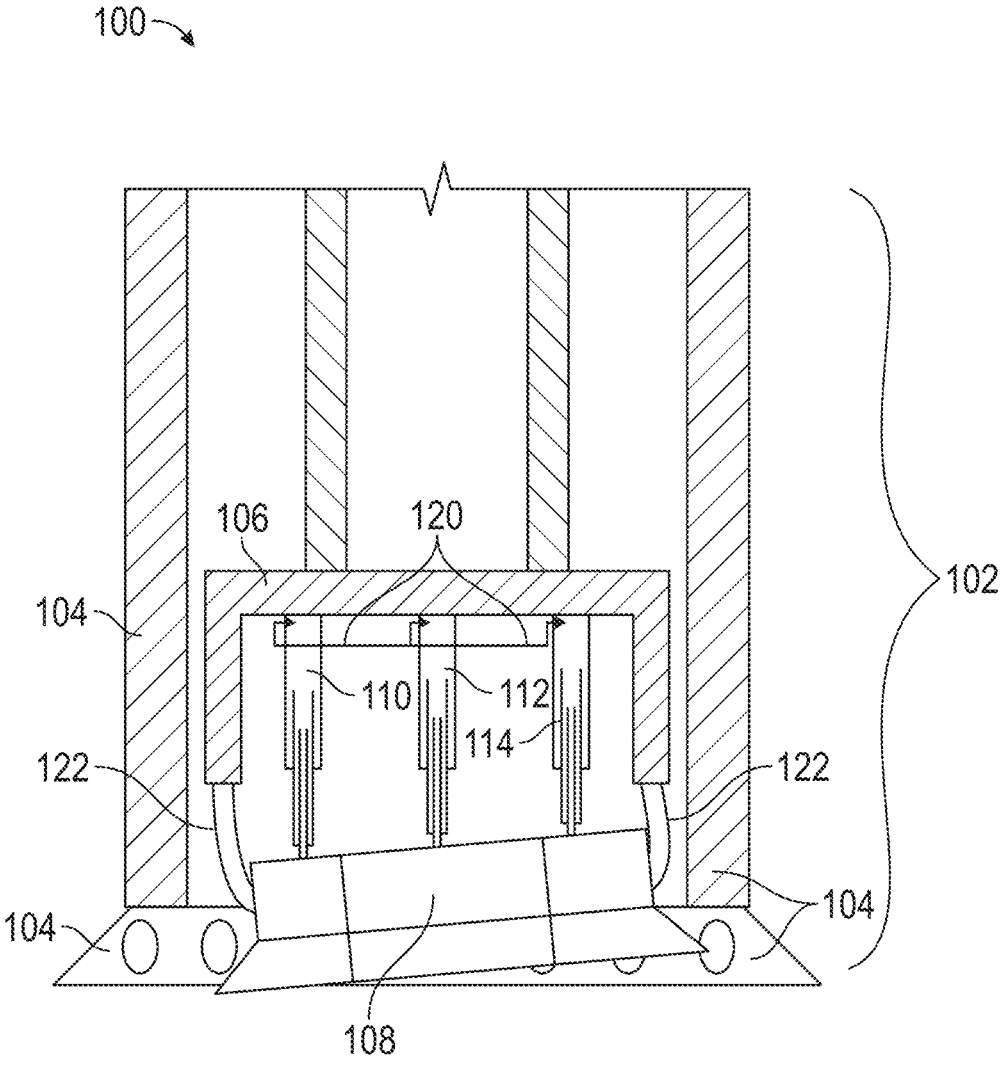
FIG. 1 is a cross-sectional side view of an example pulsed power drill bit, according to some implementations.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Example implementations relate to directional drilling of pulsed power technology for electro-crushing drilling. In pulsed power drilling, the drill bit is different from conventional drill bits in shape, size, attachments, and operation.

Also, the pulsed power drill (PPD) bit may have at least two separate parts (the center electrode(s) and the outer ground structure (e.g., ring). The outer ground structure may be attached rigidly to a bottom hole assembly (BHA) housing, while the center electrode may be spring loaded and may move along the center axis. During the drilling operation, the PPD bit may apply a very high voltage pulse across and just below the rock surface. This pulse may break down the rock through an electro-crushing process (wherein an extremely high-pressure wave is created within the rock). The PPD operation may happen below the surface of the center electrode along the axis of the PPD bit.

There may be two approaches to steer the PPD system. A first approach is a traditional one wherein the bottom section of the BHA or most of the BHA is directionally tilted. In this first approach, the weight of the PPD bit needs to be accounted for as part of the directional tilting. A second approach is to directionally tilt just the center electrode.

Some implementations may include a pulsed power drill bit that includes a floating electrode positioned within a ground structure. The floating electrode may include a fixed plate and a movable plate. At least one actuator may be positioned between the fixed plate and the movable plate. One or more actuators may move the movable plate in different directions relative to the fixed plate to allow for a change in a direction of the drilling of the wellbore. For example, the one or more actuators may cause the movable plate to tip or tilt relative to the fixed plate to change a direction of the drilling of the wellbore. Additionally, one or more actuators may move the movable plate relative to the fixed plate to facilitate reliable ignition for the pulsed power operation. For example, the one or more actuators may cause the movable plate to extend or retract so that the drill bit is in contact with the bottom of the wellbore prior to emission of the pulse of power. Accordingly, example implementations may include tilting and tipping of the center electrode plate with a properly shaped outer ground ring. Such implementations may also allow for extending and retracting of the center electrode (thus facilitating reliable ignition of the pulse).

In some implementations, the center electrode may include one fixed plate and one movable plate. At least one actuator may be attached between the two plates. For example, three or more actuators may be attached. The extension and contraction of the actuators between the plates may define the directional tilt of the movable plate. The center electrode tip may be attached to the movable plate and may be electrically connected to the pulsed power circuit.

Different methods of control (such as digital, pulse width modulation (PWM), analog, etc.) may be used to control the drilling directionality. Piloting modes may include vertical drilling, horizontal drilling, trajectory drilling, etc. In addition, the pulsed power drilling may require arc initiation modes where the electrode is retracted and extended dynamically. In some implementations, the actuators may be hydraulic and controlled by a hydraulic power unit (HPU). Additionally, the system processor may be located at the top of the BHA away from ultra-high voltage pulsed power section. Accordingly, example implementations may include a new approach to pulsed power drilling that includes this type of piloting by independently controlling position, tilt and tip of the center electrode.

In some implementations, four or more actuators may be used for robustness and redundancy. Additionally, any type of actuator (hydraulic, piezoelectric, etc.) may be used. In some implementations, there may be a rigid or a flexible connection between the actuators and the fixed plate and movable plate.

In some implementations, the center electrode may deliver a high voltage pulse (either negative or positive), and the ground structure may be the ground electrode that is to receive the pulse after it is transmitted through the subsurface formation into which the wellbore is being drilled.

Example Pulsed Powered Drill Bit

Figure 2:
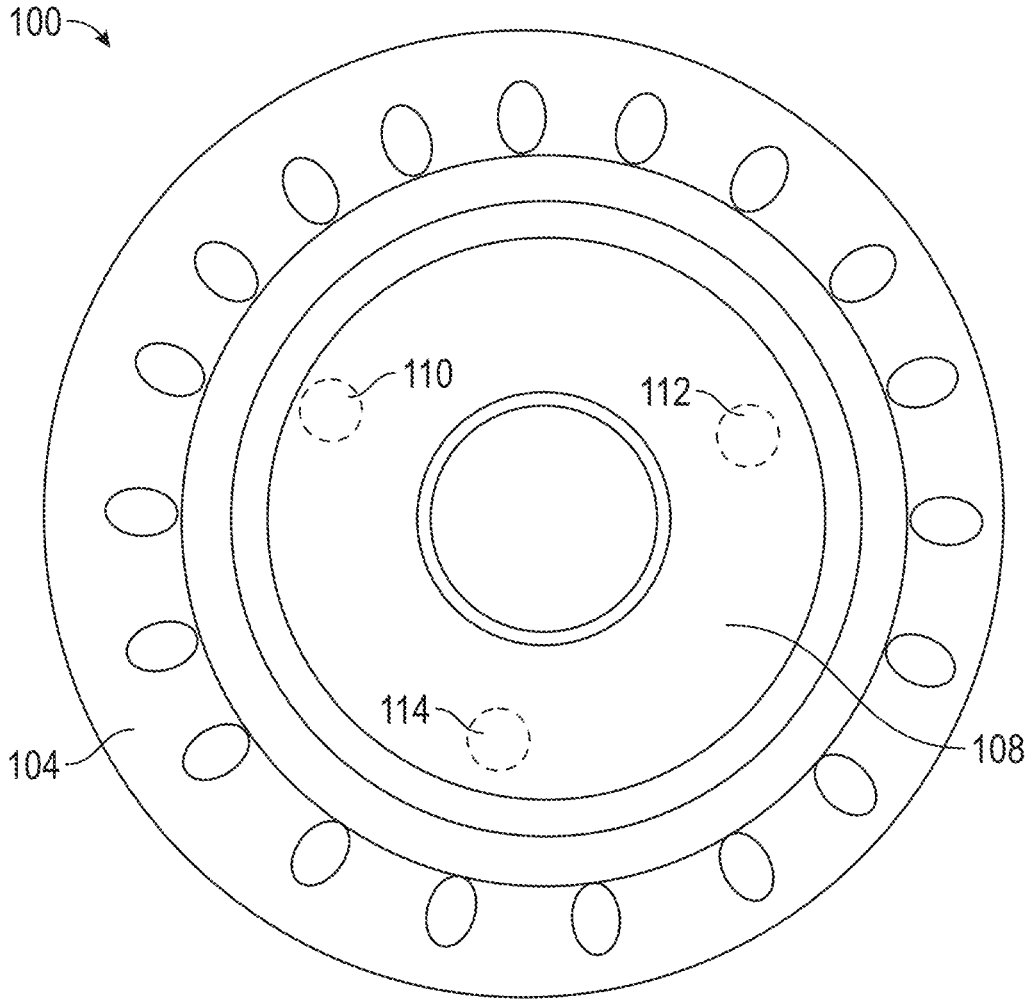
FIG. 2 is a bottom view of an example pulsed power drill bit of FIG. 1, according to some implementations.

FIG. 1 is a cross-sectional side view of an example pulsed power drill bit, according to some implementations. FIG. 2 is a bottom view of an example pulsed power drill bit of FIG. 1, according to some implementations. FIG. 1 includes a pulsed power drill bit 100 that includes an electrode assembly 102 positioned within a ground structure 104. For example, the ground structure 104 may be a ground ring. The electrode assembly 102 may be electrically coupled to a power source that is to supply current for emission into a subsurface formation formed in a wellbore for drilling the wellbore. Examples of such systems are further described below in reference to FIGS. 10-11. The electrode assembly 102 includes a fixed plate 106 and a movable plate 108. The electrode assembly 102 may include at least one actuator coupled between the fixed plate 106 and the movable plate 108. In this example, the electrode assembly 102 includes three actuators-actuators 110-114. In the example of FIG. 2, the actuators 110-114 may be spaced approximately equidistant from each other around movable plate 108. For example, the difference in distance between each of the actuators 110-114 may be zero, less than 1%, less than 2%, less than 5%, less than 10%, etc. The actuators 110-114 may be different types of actuators (such as hydraulic, piezoelectric, etc.). Additionally, in some implementations, any other type of device may be used to provide movement between the fixed plate 106 and the movable plate 108.

The actuators 110-114 may be adjusted to allow for full flexibility of the movable plate relative to the fixed plate. Such a configuration may allow for directional drilling (via tipping and tilting of the movable plate). In other words, the actuators 110-114 may be used to change an angle of the drilling. Additionally, such a configuration may facilitate reliable ignition (via extending and retracting of the movable plate) to ensure that the center electrode (the electrode assembly 102) is in contact with a bottom of the wellbore.

The electrode assembly 102 also includes a flexible connection 122 for providing a coupling on the outer portion of the fixed plate 106 to the movable plate 108. The flexible connection 122 may be different types of electrical connections (such as copper bellows). The flexible connection 122 may also contain the drilling fluid that is delivered through the center electrode assembly. The drilling fluid may then be emitted out a bottom of the center electrode assembly because of this containment. In some implementations, the actuators 110-114 may not be a conduit of delivery of the high voltage pulse. Instead the current flow may be through the fixed plate 106, the flexible connection 122, and the bottom plate 108.

Figure 3:
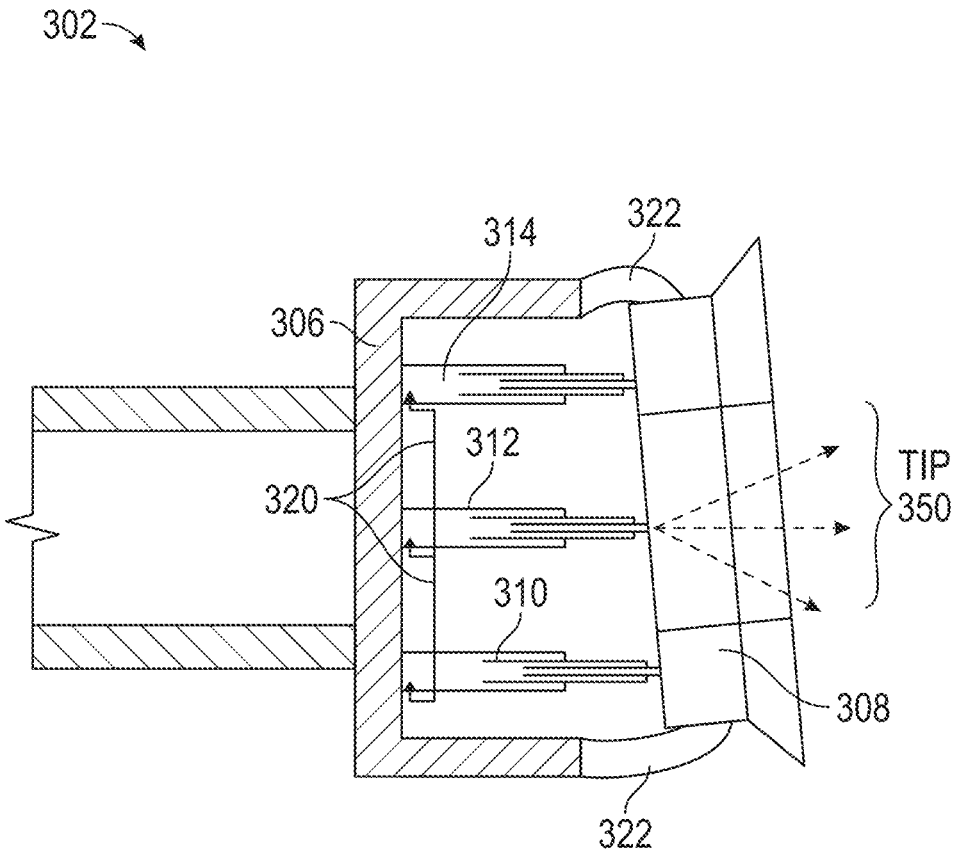
FIG. 3 is a cross-sectional side view of an example pulsed power drill bit that provides for tipping of the pulsed power drill bit to change a drilling direction of a wellbore, according to some implementations.
Figure 4:
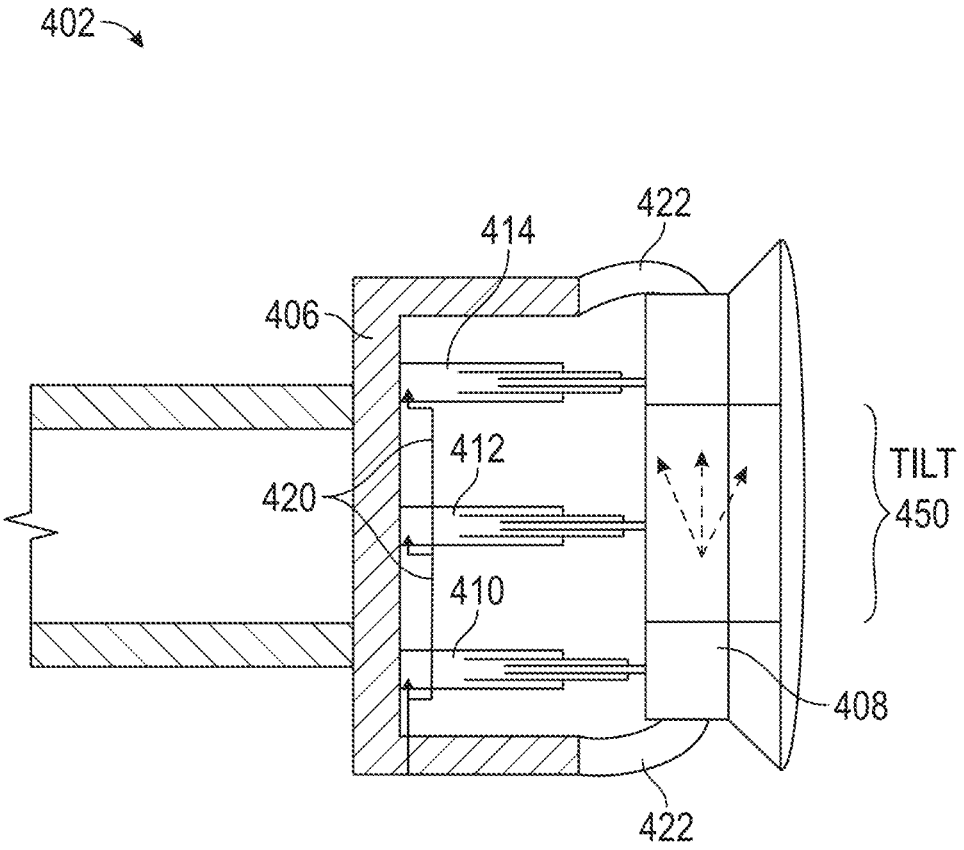
FIG. 4 is a cross-sectional side view of an example pulsed power drill bit that provides for tilting of the pulsed power drill bit to change a drilling direction of a wellbore, according to some implementations.
Figure 5:
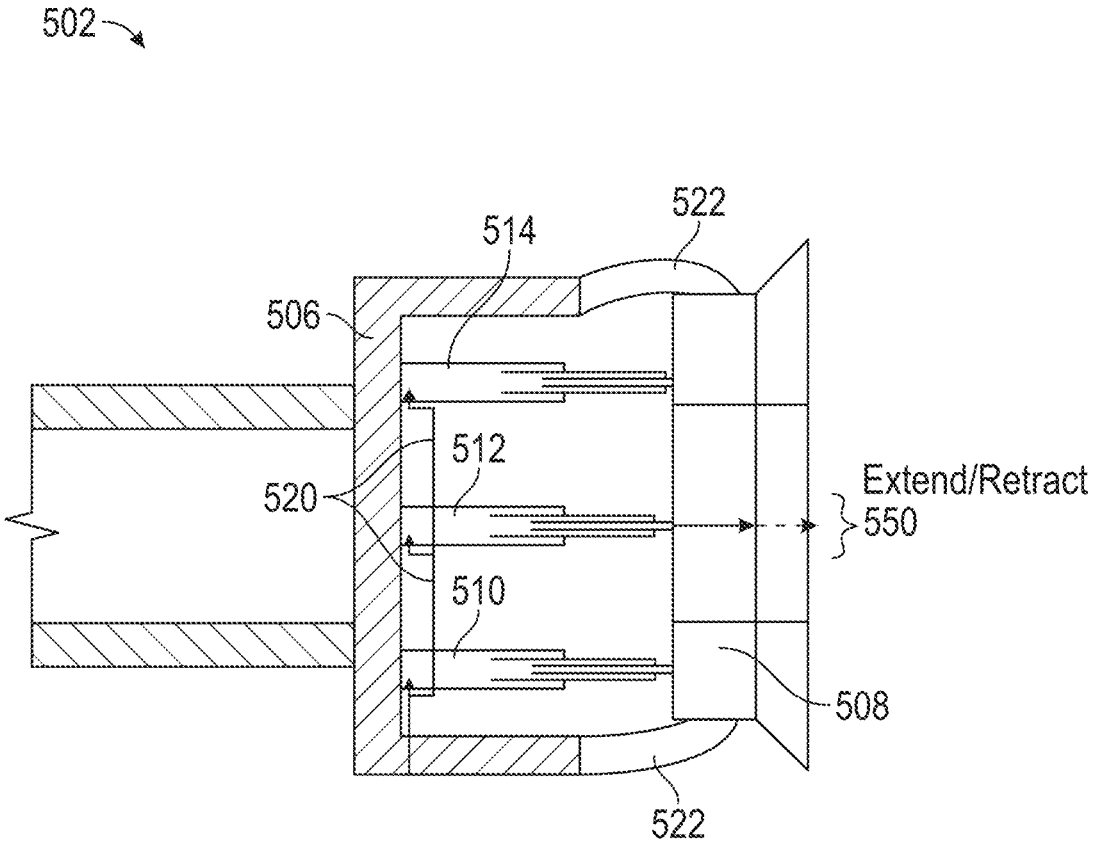
FIG. 5 is a cross-sectional side view of an example pulsed power drill bit that provides for extending and retracting of the pulsed power drill bit to facilitate reliable ignition, according to some implementations.

Example implementations that may allow for different movement are now described in reference to FIGS. 3-5. FIG. 3 is a cross-sectional side view of an example pulsed power drill bit that provides for tipping of the pulsed power drill bit to change a drilling direction of a wellbore, according to some implementations.

FIG. 3 includes an electrode assembly 302 that may be the part of a pulsed power drill bit and is positioned within a ground structure (similar to the pulsed power drill bit 100 of FIGS. 1-2). The electrode assembly 302 may be electrically coupled to a power source that is to supply current for emission into a subsurface formation formed in a wellbore for drilling the wellbore. Examples of such systems are further described below in reference to FIGS. 10-11. The electrode assembly 302 includes a fixed plate 306 and a movable plate 308. The electrode assembly 302 may include at least one actuator coupled between the fixed plate 306 and the movable plate 308. In this example, the electrode assembly 302 includes three actuators-actuators 310-314. The actuators 310-314 may be spaced approximately equidistant from each other around movable plate 308. For example, the difference in distance between each of the actuators 310-314 may be zero, less than 1%, less than 2%, less than 5%, less than 10%, etc. The actuators 310-314 may be different types of actuators (such as hydraulic, piezoelectric, etc.). Additionally, in some implementations, any other type of device may be used to provide movement between the fixed plate 306 and the movable plate 308. In this example, the actuators 310-314 may be adjusted to allow for tipping of the movable plate 308 relative to the fixed plate 306.

The electrode assembly 302 also includes a flexible connection 322 for providing a coupling on the outer portion of the fixed plate 306 to the movable plate 308. The flexible connection 322 may be different types of electrical connections (such as copper bellows). The flexible connection 322 may also contain the drilling fluid that is delivered through the center electrode assembly. The drilling fluid may then be emitted out a bottom of the center electrode assembly because of this containment. In some implementations, the actuators 310-314 may not be a conduit of delivery of the high voltage pulse. Instead the current flow may be through the fixed plate 306, the flexible connection 322, and the bottom plate 308. In this example, the actuators 310-314 may be controlled to allow for tipping of the center electrode to allow for a change in a direction of the drilling (shown as tip 350).

FIG. 4 is a cross-sectional side view of an example pulsed power drill bit that provides for tilting of the pulsed power drill bit to change a drilling direction of a wellbore, according to some implementations. FIG. 4 includes an electrode assembly 402 that may be the part of a pulsed power drill bit and is positioned within a ground structure (similar to the pulsed power drill bit 100 of FIGS. 1-2). The electrode assembly 402 may be electrically coupled to a power source that is to supply current for emission into a subsurface formation formed in a wellbore for drilling the wellbore. Examples of such systems are further described below in reference to FIGS. 10-11. The electrode assembly 402 includes a fixed plate 406 and a movable plate 408. The electrode assembly 402 may include at least one actuator coupled between the fixed plate 406 and the movable plate 408. In this example, the electrode assembly 402 includes three actuators-actuators 410-414. The actuators 410-414 may be spaced approximately equidistant from each other around movable plate 408. For example, the difference in distance between each of the actuators 410-414 may be zero, less than 1%, less than 2%, less than 5%, less than 10%, etc. The actuators 410-414 may be different types of actuators (such as hydraulic, piezoelectric, etc.). Additionally, in some implementations, any other type of device may be used to provide movement between the fixed plate 406 and the movable plate 408. In this example, the actuators 410-414 may be adjusted to allow for tipping of the movable plate 408 relative to the fixed plate 406.

The electrode assembly 402 also includes a flexible connection 422 for providing a coupling on the outer portion of the fixed plate 406 to the movable plate 408. The flexible connection 422 may be different types of electrical connections (such as copper bellows). The flexible connection 422 may also contain the drilling fluid that is delivered through the center electrode assembly. The drilling fluid may then be emitted out a bottom of the center electrode assembly because of this containment. In some implementations, the actuators 410-414 may not be a conduit of delivery of the high voltage pulse. Instead the current flow may be through the fixed plate 406, the flexible connection 422, and the bottom plate 408. In this example, the actuators 410-414 may be controlled to allow for tilting of the center electrode to allow for a change in a direction of the drilling (shown as tilt 450).

FIG. 5 is a cross-sectional side view of an example pulsed power drill bit that provides for extending and retracting of the pulsed power drill bit to facilitate reliable ignition, according to some implementations. FIG. 5 includes an electrode assembly 502 that may be the part of a pulsed power drill bit and is positioned within a ground structure (similar to the pulsed power drill bit 100 of FIGS. 1-2). The electrode assembly 502 may be electrically coupled to a power source that is to supply current for emission into a subsurface formation formed in a wellbore for drilling the wellbore. Examples of such systems are further described below in reference to FIGS. 10-11. The electrode assembly 502 includes a fixed plate 506 and a movable plate 508. The electrode assembly 502 may include at least one actuator coupled between the fixed plate 506 and the movable plate 508. In this example, the electrode assembly 502 includes three actuators-actuators 510-514. The actuators 510-514 may be spaced approximately equidistant from each other around movable plate 508. For example, the difference in distance between each of the actuators 510-514 may be zero, less than 1%, less than 2%, less than 5%, less than 10%, etc. The actuators 510-514 may be different types of actuators (such as hydraulic, piezoelectric, etc.). Additionally, in some implementations, any other type of device may be used to provide movement between the fixed plate 506 and the movable plate 508. In this example, the actuators 510-514 may be adjusted to allow for tipping of the movable plate 508 relative to the fixed plate 506.

The electrode assembly 502 also includes a flexible connection 522 for providing a coupling on the outer portion of the fixed plate 506 to the movable plate 508. The flexible connection 522 may be different types of electrical connections (such as copper bellows). The flexible connection 522 may also contain the drilling fluid that is delivered through the center electrode assembly. The drilling fluid may then be emitted out a bottom of the center electrode assembly because of this containment. In some implementations, the actuators 510-514 may not be a conduit of delivery of the high voltage pulse. Instead the current flow may be through the fixed plate 506, the flexible connection 522, and the bottom plate 508. In this example, the actuators 510-514 may be controlled to allow for extending/retracting of the center electrode to facilitate reliable ignition by having the fixed plate in contact with a bottom of the wellbore (shown as extend/retract 550).

Figure 6:
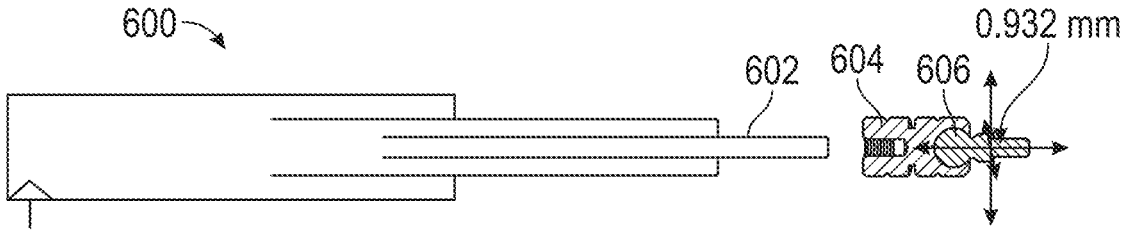
FIG. 6 is a cross-sectional side view of an actuator and an axial ball joint between a shaft of the actuator and movable plate of the electrode, according to some implementations.
Figure 7:
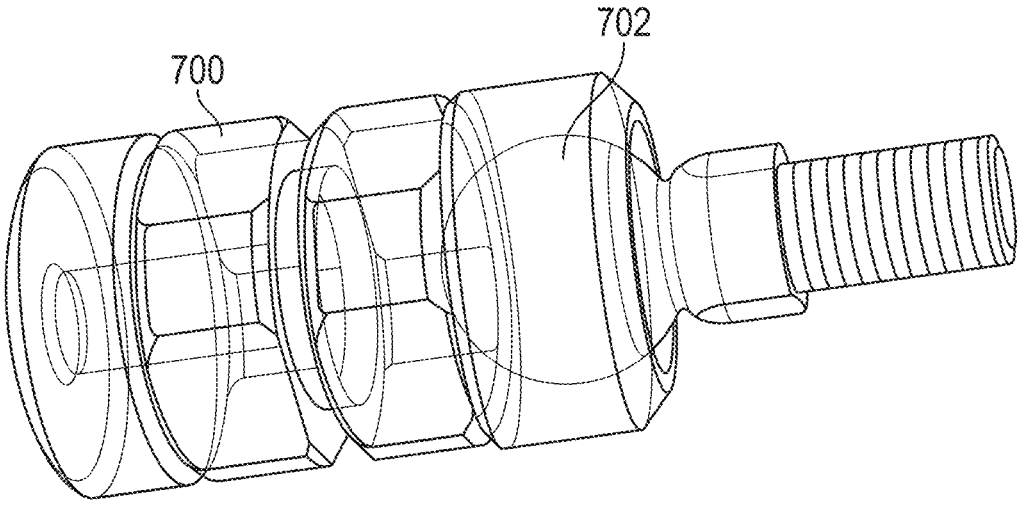
FIG. 7 is a perspective view of an axial ball joint, according to some implementations.
Figure 8:
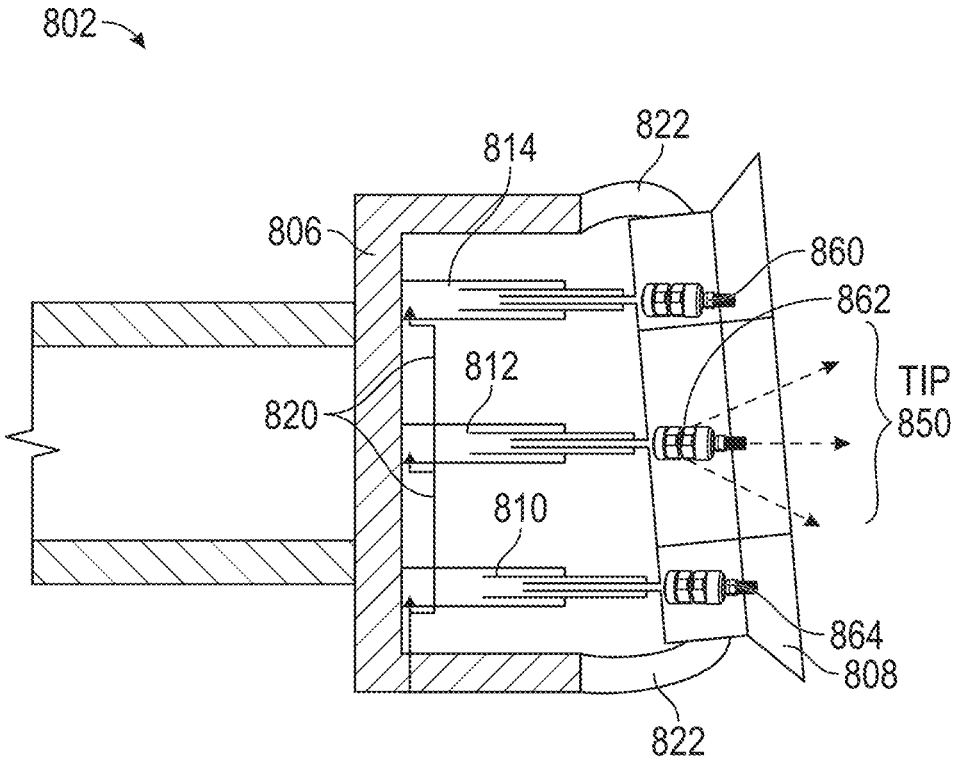
FIG. 8 is a cross-sectional side view of an example pulsed power drill bit that provides for tipping of the pulsed power drill bit (that includes axial ball joints) to change a drilling direction of a wellbore, according to some implementations.

The connection between the actuators and the movable plate may be any type of connection. For example, the connection may be rigid or flexible (such as a flexible joint). FIGS. 6-8 depict examples of a flexible joint as an axial ball joint.

FIG. 6 is a cross-sectional side view of an actuator and an axial ball joint between a shaft of the actuator and movable plate of the electrode, according to some implementations. FIG. 6 depicts an actuator 600 that includes a shaft 602. The shaft 602 is placed into a housing 604 (that includes the axial ball joint 606). The housing 604 may be imbed or a part of the movable plate of the electrode (as further described below). Such a configuration secures the actuator 600 to the movable plate while also allowing for movement axially around the axial ball joint 606. As shown, in some implementations, the shaft 602 may be screwed into the housing 604.

FIG. 7 is a perspective view of an axial ball joint, according to some implementations. FIG. 7 depicts a housing 700 that includes an axial ball joint 702. Such a housing may be imbedded or positioned in the movable plate of the electrode.

FIG. 8 is a cross-sectional side view of an example pulsed power drill bit that provides for tipping of the pulsed power drill bit (that includes axial ball joints) to change a drilling direction of a wellbore, according to some implementations.

The use of axial ball joints may allow for a more uniform distribution of force to the movable plate. While FIGS. 6-8 depict a full axial ball joint, in some implementations, a partial axial ball joint may be used. For example, a partial axial ball joint may be used that may include less than 180 degree rotation.

Example Pulse Power Drill Bit Control Architecture

Figure 9:
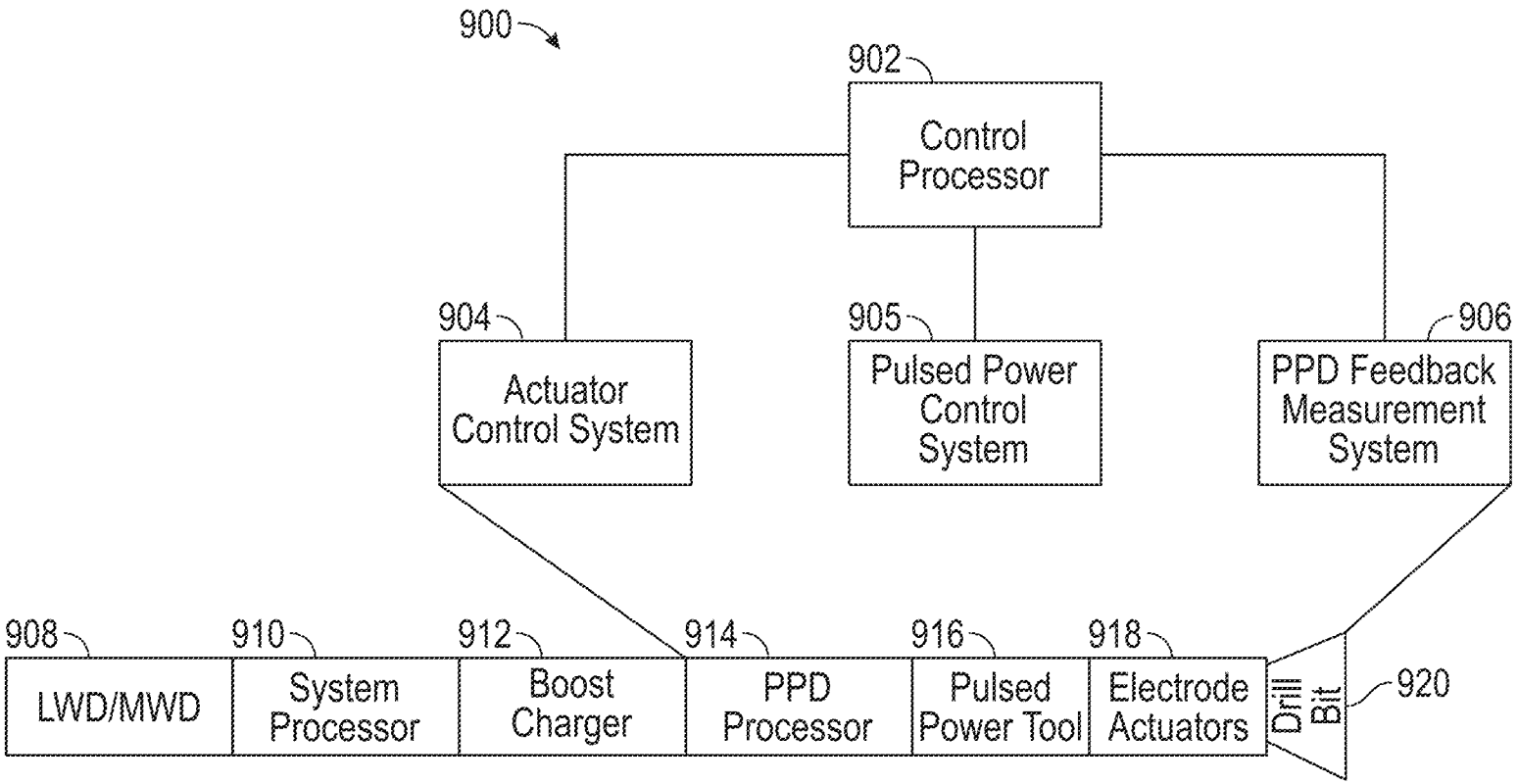
FIG. 9 is a block diagram of an example pulse power drill bit control architecture, according to some implementations.

FIG. 9 is a block diagram of an example pulse power drill bit control architecture, according to some implementations. FIG. 9 depicts a pulse power drill bit control architecture 900 that includes a control processor 902 that is coupled to an actuator control system 904, a pulsed power control system 905, and a pulsed power drilling feedback measurement system 906. The control processor 902, the actuator control system 904, the pulsed power control system 905, and the pulsed power drilling (PPD) feedback measurement system 906 may be at the surface and/or downhole in the wellbore. The pulse power drill bit control architecture 900 also includes parts of the drill string that includes a logging while drilling (LWD)/measurement while drilling (MWD) tool 908, a system processor 910, a boost charger 912, a pulse power drilling processor 914, a pulsed power tool 916, electrode and actuators 918, and a drill bit 920. The actuator control system 904 is coupled to the system processor 910. The PPD feedback measurement system 906 is coupled to the drill bit 920. Example operations of the pulse power drill bit control architecture 900 are further described in reference to FIGS. 10-12.

Example Systems

Figure 10:
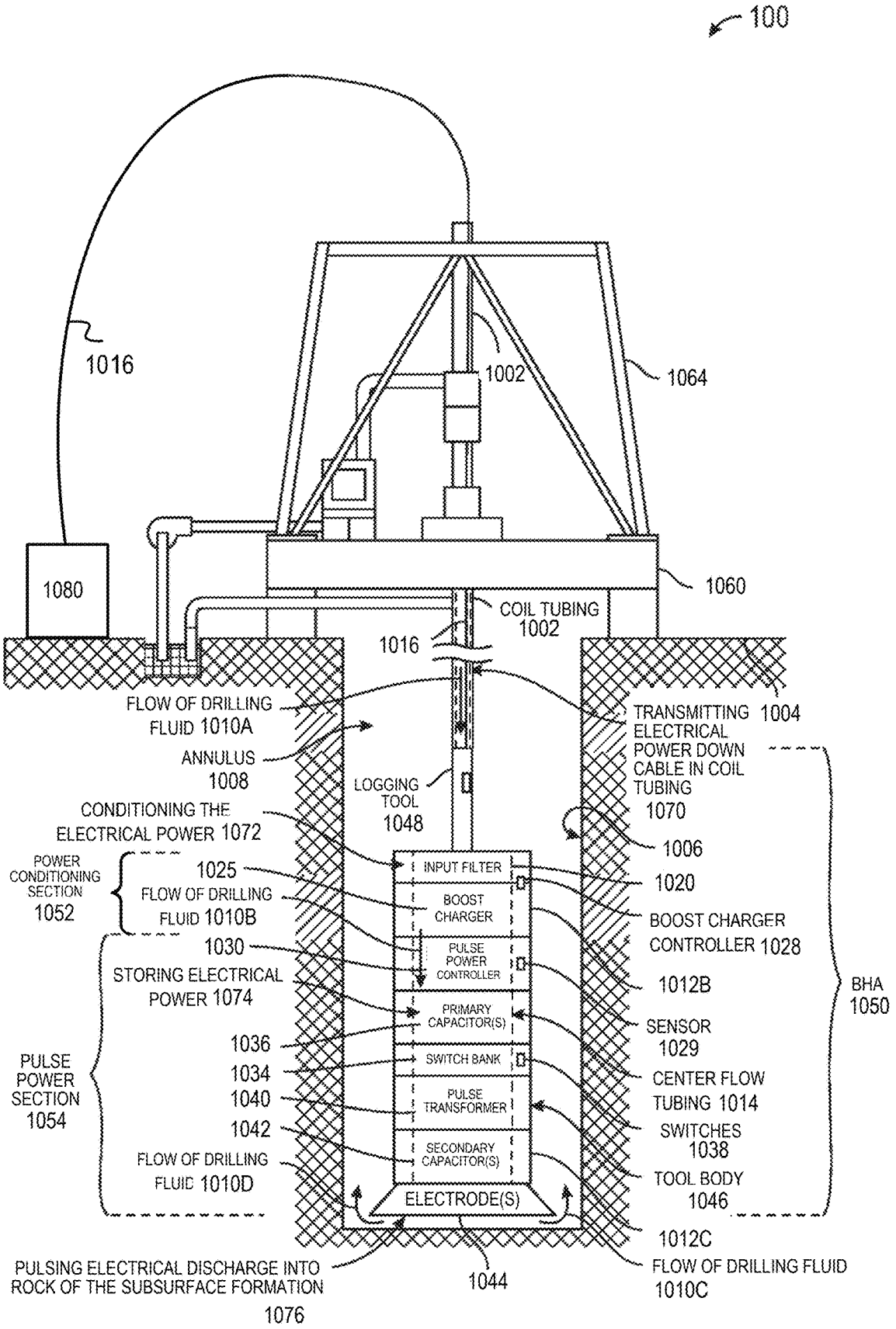
FIG. 10 is a schematic diagram depicting an example coiled tubing pulsed power drilling assembly, according to some implementations.
Figure 11:
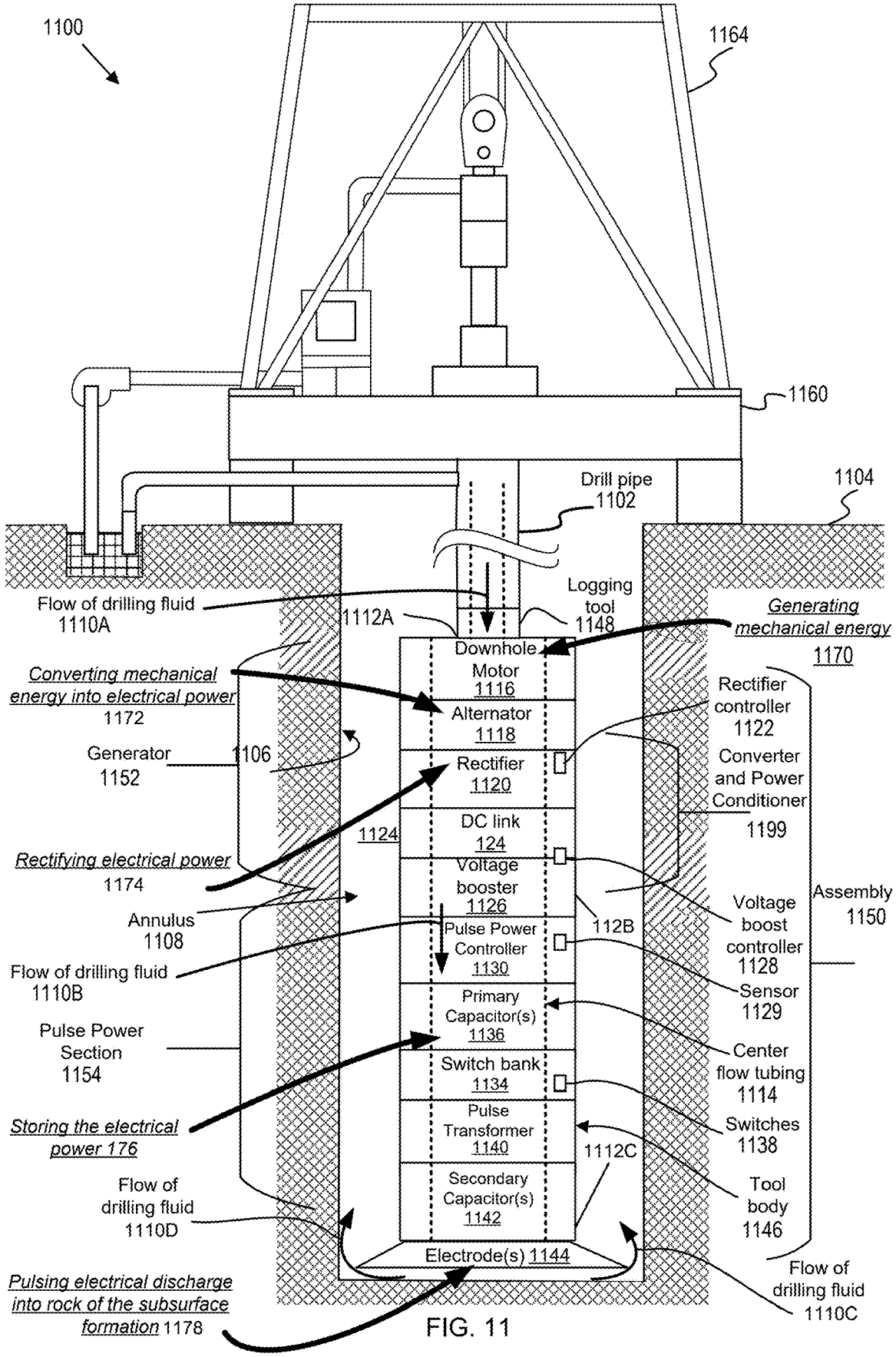
FIG. 11 depicts an example pulse power drilling assembly that is powered based on fluid flow in the wellbore, according to some embodiments.

Example systems that may include piloting pulsed power drilling using a multi-actuator based floating electrode (as described herein) are now described in reference to FIGS. 10-11. FIG. 10 is a schematic diagram depicting an example coiled tubing pulsed power drilling assembly, according to some implementations. An example pulsed power drilling system 1000 may perform or be used to perform a number of example pulsed power drilling (PPD) operations 1070-1076. The pulsed power drilling operations 1070-1076 are described in more detail below (after the description of the different parts of the example pulsed power drilling system 1000).

The example pulsed power drilling system 1000 may include a pulsed power drilling bottomhole assembly (hereinafter "BHA") 1050 positioned in a wellbore 1006 and coupled to a coiled tubing 1002. The coiled tubing 1002 may comprise one or more coiled tubing strings sourced from one or more coiled tubing reels (not shown). The one or more coiled tubing strings (i.e., coiled tubing from one or more reels) may be coupled together to reach a target depth in the wellbore 1006. While depicted on the surface 1004 as an onshore drilling operation, example implementations may also be performed as an offshore drilling operation.

In some implementations, the delivered power supplied may be used to perform pulse power drilling. In particular, conventional wellbore drilling includes rotary drilling using a drill bit having cutting elements that is rotated to cause a cutting (fracturing or crushing) of rock. In contrast, pulse power drilling extends the wellbore using discharges of electric pulses that may include short duration, periodic, high-voltage pulses that are discharged through the rock in a surrounding formation. Such discharges may create an internal pressure which applies a tensional stress substantial to break or fracture the rock in tension. Pulse power drilling may create a plasma in a drilling fluid or rock downhole which functions as a high-energy discharge. The creation of the plasma downhole may involve injecting large amounts of energy into the subsurface formation. Thus, pulse power drilling may require substantial amounts of both voltage and current for successful breakage or fracturing of rock in a downhole environment.

The BHA 1050 may be configured to further the advancement of the wellbore 1006 using by pulsing electrical power generated by a power supply 1080 at the surface 1004 and transmitted to electrodes 1044 via a cable 1016. The electrodes 1044 may be configured to emit an electrical discharge through formation material of a subsurface formation along the bottom face of the wellbore 1006 and in the nearby proximity to the electrodes 1044. The cable 1016 may be capable of supplying power from the power supply 1080 at an order of magnitude which provides for the creation of the plasma upon pulse discharges into the formation. The cable 1016 may also be capable of transmitting enough power such that an electrical discharge emitted into the formation creates a sufficient amount of high internal pressure to destroy the rock in tension, as described above.

In some implementations, the cable 1016 may comprise a single conductor cable or a multiconductor cable. To convey electrical power, the cable 1016 may be configured to supply high-voltage DC power to the electrodes 1044. In some implementations, a fiber optic cable or a coaxial communication cable may be part of the multiconductor cable configuration to transmit data between the surface 1004 and the BHA 1050. Alternatively or in addition, a fiber optic cable or a coaxial communication cable may be a separate cable that is conveyed downhole within the coiled tubing 1002. Using a cable rather than using other communication mediums (e.g., mud pulse telemetry) may enable high speed communication with equipment at the surface 1004. The cable(s) 1016 may utilize a single solid cable, a solid multi-cable configuration, or stranded cables that are configured to have a low inductance.

While conveying such a cable to depth with a traditional segmented drill pipe may prove exceedingly difficult, the coiled tubing 1002 may allow for both the cable 1016 to be housed within and may also allow drilling fluid or mud to flow from the surface to downhole to provide cooling to the electrodes 1044, removing of cuttings, etc. For example, each coiled tubing reel may comprise up to 5,000 ft of coiled tubing, although various sizes of reels may be used, whereas a stand (typically comprising three or four individual joints) of segmented drill pipe may be between 30-55 ft in length. Thus, the segmented drill pipe may require additional drill pipe to be added every 30-55 ft of drilling, and running a power cable within the drill pipe in this configuration may prove to be difficult. In some implementations, the coiled tubing reel(s) configured to store the coiled tubing 1002 at the surface 1004 may have an increased inductance when compared to the cable 1016 and BHA 1050 in the wellbore 1006. This increased inductance may occur because the cable 1016 is wound within or otherwise with the coiled tubing 1002 in the reel. The inductance of the coiled tubing reel may increase with the number of turns the coil tubing 1002 and cable 1016 make around the reel. As more coiled tubing 1002 is conveyed into the wellbore 1006, the inductance may decrease over time. The difference in inductance at the reel and the cable 1016 in the wellbore 1006 may induce a voltage overshot and/or ringing from the power supply 1080 when transmitting pulsed power to the capacitors 1036, 1042. The input filter 1020, coupled in series with the cable 1016 and power supply 1080, may be configured to reduce the ringing caused by the inductance discrepancies.

In some implementations, continuous tubing such as the coiled tubing 1002 may allow for longer wells to be drilled using a pulse-power drill string. For example, one or more coiled tubings (also referred to as coiled tubing strings) 1002 housing the cable 1016 may allow the BHA 1050 to receive consistent, direct DC power from the power supply 1080 via the cable 1016 coupled to the coiled tubing 1002. This sustained level of power may enable the BHA 1050 to extend the wellbore 1006 up to 2-3 miles vertically. The BHA 1050 and electrodes 1044, with the benefit of consistent, high voltage DC power, may be capable of extending the wellbore 1006 up to 7 miles laterally, which may not be feasible with intermittent power sources used in other pulsed power drilling operations. As further described below, the constant supply of high voltage DC power may be used to power one or more downhole operations in addition to drilling the wellbore 1006. For example, DC power output from the power supply 1080 may be used to power one or more of the following: nuclear magnetic resonance (NMR) operations, mud pulsing, geosteering equipment, measurement-while drilling (MWD) equipment, etc.

The cable 1016 may be configured to reduce conduction losses and total voltage drop as power travels from the power supply 1080 to the BHA 1050. Compared to more traditional configurations using a downhole power generation device and hydraulic power generation (downhole generator/turbine, alternator, etc.), the cable 1016 may be configured to efficiently deliver up to 1,000 kilowatts (kW) of impedance-matched power to the BHA 1050 with minimal losses. In some implementations, the cable 1016 may deliver 200 kilovolts (kV) to the electrodes 1044. The cable 1016 may be mounted or otherwise secured within the coiled tubing 1002. In some implementations, the cable 1016 may be pre-assembled within the coiled tubing 1002. In other implementations, the cable may be mounted or strapped to the outside of the coiled tubing 1002. While delivering high power to the electrodes 1044, the cable(s) 1016 may be properly supported within or against the coiled tubing 1002 to withstand a fast-flowing drilling fluid, both for inflow of drilling fluid down the coiled tubing 1002 and an outflow of drilling fluid up the annulus 1008. For example, drilling fluid sent down the coiled tubing 1002 may be highly viscous and under high pressure. Accordingly, the coiled tubing 1002 and cable 1016 may form a mud-flow pipe that may also deliver electrical power to the BHA 1050.

Using the cable 1016 to transmit the electrical power to the BHA 1050 may also improve the thermal efficiency of the system. For example, a downhole power source, motor, or generator may concentrate heat losses at a single area in the wellbore 1006 (within a 75-100 ft interval). Drilling fluid in the area may be heated beyond a desired temperature, and the drilling fluid may require cycling out of the wellbore 1006 at a quicker rate. However, heat losses from the cable 1016 may be distributed more evenly in the wellbore 1006 across the entire length of the cable 1016. The distributed heat losses from the cable 1016 may optimize thermal management in the wellbore 1006 and enable a higher rate of penetration (ROP) of the BHA 1050. Lower heat losses may enable the pulsed power section 1054 to operate more efficiently, which may enable the electrodes 1044 to arc into the formation (thus, drilling the formation) at an increased rate. In addition to minimizing heat losses, the pulsed power drilling system 1000 may also be configured to minimize power losses. Utilizing the cable 1016 eliminates the need for a complex power conversion apparatus. The power topology comprising the power supply 1080, the cable 1016, and the boost charger 1025 may reduce power losses during the delivery of a required charge to the electrodes 1044 when compared to more traditional PPD systems.

As illustrated in FIG. 10, the BHA 1050 includes multiple sub-assemblies, including, in some implementations, an input filter 1020 at a top of the BHA 1050. The top of the assembly is a face of the BHA 1050 furthest from a drilling face of the BHA 1050 (which contains the electrodes 1044). The input filter 1020 is coupled to multiple additional sub-sections or components. The input filter 1020 may be configured to reduce ripples in current and/or voltage output from the power supply 1080 and along the cable 1016. A boost charger 1025 (comprising a voltage booster or similar power converter and a multi-mode capacitor charger) positioned below the input filter 1020 may be configured to receive the filtered electrical power output from the input filter 1020. In some implementations, the multi-mode capacitor charger may be a smart charger capable of fast charging. For example, the multi-mode capacitor charger may be configured to switch between a constant current mode and constant power mode to optimize charging of the primary capacitor(s) 1036 depending upon which modes charge the capacitors 1036, 1042 fastest. The BHA 1050 may additionally comprise a pulsed power controller 1030, a switch bank 1034 (including one or more switches 1038), one or more primary capacitor(s) 1036, a pulse transformer 1040 with one or more primary and secondary windings, one or more secondary capacitors 1042, and the electrodes 1044. In some implementations, the power supply 1080 (at the surface 1004), the cable 1016, input filter 1020, and boost charger 1025 (located in the wellbore 1006) may be referred to as a power delivery system.

DC power output from the power supply 1080 may be stored in the capacitors 1026, 1042 prior to a discharge criteria being satisfied. For example, a discharge or load criteria may be that a defined amount of energy has been stored. As an example, this criteria may be satisfied when the primary capacitor(s) 1036 is fully charged. In another example, this criteria may be satisfied when the amount of energy that has been stored is sufficient to break the rock in the current subsurface formation. Accordingly, the amount of energy needed may vary depending on the type of rock. In another example, the criteria may be that a bottom of the pulse power drill string is in contact with a bottom of the wellbore 1006. This may include any contact or some defined amount of surface area of the bottom of the pulse power drill string being in contact. In another example, the discharge criteria may be a defined amount of time since a prior electrical discharge.

In some implementations, the power may continue to be supplied by the cable 1016 after the primary capacitor(s) 1036 is fully charged. After the amount of energy stored in the primary capacitor(s) 1036 exceeds a defined amount (e.g., fully charged), a switch within switch bank 1034 may be opened to prevent additional storage of energy in the primary capacitor(s) 1036 until the energy is discharged therefrom to generate a pulse of electrical discharge emitted into the subsurface formation. The switch may then be closed to again allow for storage of energy in the primary capacitor(s) 1036.

The BHA 1050 may be divided into a power conditioning section (PCS) 1052 and a pulsed power section 1054. The power conditioning section 1052 may include the input filter 1020 and the boost charger 1025. The power supply 1080 may be configured to deliver medium voltage or high voltage DC power to the boost charger 1025 and power conditioning section 1052 which in turn sends power to charge one or more capacitors (1036, 1042) of the pulsed power section 1054. The pulsed power section 1054 may include the pulsed power controller 1030, the switch bank 1034 (and switch(es) 1038), the one or more primary capacitor(s) 1036, the pulsed transformer 1040, the one or more secondary capacitors 1042, and the electrodes 1044. Components may be divided between the power conditioning section 1052 and the pulsed power section 1054 in other arrangements, and the order of the components may be other than shown.

While a single boost charger 1025 is depicted in FIG. 10, two or more boost chargers may be used along different locations along the coiled tubing 1002 to boost the voltage of received power and to charge the capacitors 1036, 1042. For example, a boost charger 1025 may be installed at one or more locations in the coiled tubing 1002. In some implementations, as multiple reels of coiled tubing are conveyed into the wellbore 1006, couplings between each coiled tubing string may comprise a boost charger 1025. Each of the boost chargers along the coiled tubing 1002 (or string of coiled tubings) may be configured to increase the voltage stepwise until reaching the capacitors 1036, 1042 where a final boost charger proximate to the BHA 1050 may be used to charge the capacitors 1036, 1042.

In some implementations, DC electrical power may be conditioned by one or more input filters before storage in primary capacitor(s) 1036 in the BHA 1050 (as stored energy). For example, the power conditioning section 1052 (or PCS) may be configured to condition electrical power prior to use within and eventual discharge from the pulsed power section 1054. The input filter 1020 may be configured to receive electric power from the cable 1016 and output conditioned electrical power. The conditioning may comprise filtering, by the input filter 1020, out ripples in current and voltage from the DC power received from the power supply 1080. While the DC power is continuous, the loading of the boost charger 1025 may be slightly pulsed rather than exhibiting continuous power draw. The input filter 1020 may flatten any ripple in the received DC power prior to being used in the pulsed power section 1054. Further processing of the electrical power output received at the PCS 1052 may include voltage boosting, and frequency and/or waveform smoothing or regulating of the received electrical power.

In some implementations, the secondary capacitor(s) 1042 may be configured with a higher or current rating than the primary capacitor(s) 1036. In this configuration, the power supply 1080 may be configured with a higher voltage rating (>6 kV) and may be coupled to the input filter 1020 and boost charger 1025. From the boost charger 1025, the higher voltage power may be routed to the secondary capacitor(s) 1042 and output from the electrode(s) 1044. While FIG. 10 depicts the PCS 1052 positioned in the wellbore 1006 as part of the BHA 1050, some implementations may position the input filter 1020 and boost charger 1025 at the surface 1004.

A center flow tubing 1014 may be coupled to an end of the coiled tubing 1002 and may travel through the BHA 1050, acting as a conveyance tubing. In some implementations, the center flow tubing 1014 may be a shorter section of coiled tubing configured to extend through the PCS 1052 and pulsed power section 1054. A flow of drilling fluid 1010A (illustrated by the arrow pointing downward within the coiled tubing 1002) may be provided from the drilling platform 1060, and flow to and through the power conditioning section 1052 and pulsed power section 1054 of the BHA 1050, as indicated by the arrow 1010B. The PCS 1052 may further process and controllably provide the electrical power to the rest of the downstream BHA 1050. The stored power may then be output from the electrodes 1044 to perform the advancement of the wellbore 1006 via periodic electrical discharges. In some implementations, pulsed power drilling (achieved by the periodic electrical discharges) may be capable of advancing the wellbore by 60 to 150 feet per hour through one or more hard rock (i.e., consolidated) subsurface formations. By using the coiled tubing 1002, the pulsed power drilling may avoid issues with forming connections between joints of segmented drill pipe. The use of the coiled tubing 1002 and electrodes 1044 for pulsed power drilling may also eliminate the need for multiple trips to change the drill bit.

In some implementations, the drilling fluid used in the wellbore 1006 may comprise a dielectric drilling fluid. The dielectric drilling fluid may be a mixture of drilling mud and one or more dielectric sands which may grant the drilling fluid dielectric properties. While the dielectric sands may increase the viscosity of the drilling fluid, their dielectric properties may ensure that electrical discharges emitted from the electrodes 1044 do not propagate up the wellbore 1006 or to the surface 1004.

The drilling fluid may flow through the BHA 1050, as indicated by arrow 1010B, and flow out and away from the electrodes 1044 and back toward the surface to aid in the removal of the debris generated by the breaking up of the formation material at and nearby the electrodes 1044. The fluid flow direction away from the electrodes 1044 is indicated by arrows 1010C and 1010D. In addition, the flow of drilling fluid may provide cooling to one or more devices and to one or more portions of the BHA 1050. In various implementations, it is not necessary for the BHA 1050 to be rotated as part of the drilling process, but some degree of rotation or oscillations of the BHA 1050 may be provided in various implementations of drilling processes utilizing the BHA 1050.

The flow of drilling fluid passing through the BHA 1050 may continue to flow through the center flow tubing 1014, which thereby provides a flow path for the drilling fluid through one or more sub-sections or components of the PCS 1052 and PPS 1054, as indicated by the arrow 1010B pointing downward through the cavity of the sections of the center flow tubing 1014. Once arriving at the electrodes 1044, the flow of drilling fluid may be expelled out from one or more ports or nozzles located in or in proximity to the electrodes 1044. After being expelled from the BHA 1050, the drilling fluid may flow back upward toward the surface through an annulus 1008 created between the BHA 1050 and walls of the wellbore 1006.

The center flow tubing 1014 may be located along a central longitudinal axis of the BHA 1050 and may have an overall outside diameter or outer shaped surface that is smaller in cross-section than the inside surface of a tool body 1046 in cross-section. As such, one or more spaces may be created between the center flow tubing 1014 and an inside wall of the tool body 1046. These one or more spaces may be used to house various components, such as components which make up the input filter 1020, the boost charger 1025, the boost charger controller 1028, the sensor 1029, the pulsed power controller 1030, the switch bank 1034, the one or more switches 1038, the one or more primary capacitor(s) 1036, the pulsed transformer 1040, and the one or more secondary capacitors 1042, as shown in FIG. 10. The sensor 1029 may be located in different locations within the BHA 1050. As depicted in FIG. 10, the sensor 1029 is positioned near the pulsed power controller 1030. However, the sensor 1029 may be in any location within the BHA 1050 and may include more than a single sensor (depending on the size and particular sensor measurement). Other components may be included in the spaces created between the center flow tubing 1014 and the inside wall of the tool body 1046.

The example pulsed power drilling system 1000 may include one or more logging tools 1048. The logging tool(s) 1048 are shown as being coupled to the coiled tubing 1002 within the BHA 1050. In some implementations, the logging tool 1048 may be located above the BHA 1050 or may be joined via a shop joint or field joint to BHA 1050. The logging tool(s) 1048 may include one or more logging with drilling (LWD) or measurement while drilling (MWD) tools, including a resistivity tool, gamma-ray tool, nuclear magnetic resonance (NMR) tool, etc. The logging tools 1048 may include one or more sensors to collect data downhole. For example, the logging tools 1048 may include pressure sensors, flowmeters, etc. The example pulsed power drilling system 1000 may also include directional control, such as for geosteering or directional drilling, which may be part of the BHA 1050, the logging tool(s) 1048, or located elsewhere on the coiled tubing 1002.

Communication from the pulsed power controller 1030 to the boost charger controller 1028 allows the pulsed power controller 1030 to transmit data about and modifications for pulsed power drilling to the power conditioning section 1052. Similarly, communications from the boost charger controller 1028 to the pulsed power controller 1030 may allow the power conditioning section 1052 to transmit data about and modifications for pulsed power drilling to the pulsed power section 1054. The pulsed power controller 1030 may control the discharge of the pulsed power stored for emissions out from the electrodes 1044 and into the formation, into drilling mud, or into a combination of formation and drilling fluids. The pulsed power controller 1030 may measure data about the electrical characteristics of each of the electrical discharges-such as power, current, and voltage emitted by the electrodes 1044. Based on information measured for each discharge, the pulsed power controller 1030 may determine information about drilling and about the electrodes 1044, including whether or not the electrodes 1044 are firing into the formation (i.e., drilling) or firing into the formation fluid (i.e., electrodes 1044 are off bottom). The power conditioning section 1052 may control the charge rate and charge voltage for each of the multiple pulsed power electrical discharges. The PCS 1052, with electrical power supplied via the cable 1016 may create an electrical charge in the range of 10-20 kilovolts (kV) which the pulsed power controller 1030 delivers to the formation via the electrodes 1044.

When the pulsed power controller 1030 may communicate with the power conditioning section 1052, the power conditioning section 1052 may ramp up and ramp down in response to changes or electrical discharge characteristics detected at the pulsed power controller 1030. Because the load on the power conditioning section 1052 is large (due to the high voltage), ramping up and ramping down in response to the needs of the pulsed power controller 1030 may protect the power conditioning section 1052 and associated components from load stress and may extend the lifetime of components of the pulsed power drilling assembly. If the pulsed power controller 1030 is unable to communicate with the power conditioning section 1052, then the power conditioning section 1052 may apply a constant charge rate and charge voltage to the electrodes 1044.

In instances where the BHA 1050 is off bottom, electrical power input to the system may be absorbed (at least partially) by drilling fluid, which may be vaporized, boiled off, or destroyed because of the large power load transmitted in the electrical pulses. In instances where the BHA 1050 is not operating correctly, such as when one or more switch experiences a fault or requires a reset, application of high power to the primary and/or secondary capacitors 1036/1042 or the electrodes 1044 may damage circuitry and switches when applied at unexpected or incorrect times. In these and additional cases, communications or messages between the pulsed power controller 1030 and the power conditioning section 1052 may allow the entire BHA 1050 to vary charge rates and voltages, along with other adjustments further discussed below. In cases where the pulsed power controller 1030 and power conditioning section 1052 are autonomous, i.e., not readily in communication with the surface, downhole control of the BHA 1050 may improve pulsed power drilling function.

Pulse power drilling operations may include various operations. For example, such an operation may include pulsing of an electrical discharge to breaking of rock to continue to drill the wellbore 1006 (e.g., electro-crushing). Another example operation may include pulsing of an electrical discharge while the drill string is off bottom for testing, formation evaluation, etc. Another example operation may include pulsing of an electrical discharge for communication. A series of example pulsed power drilling operations 1070-1076 are now described. A first operation 1070 includes transmitting electrical power generated from the power supply 1080 down the cable 1016 within the coiled tubing 1002. The cable 1016 may be mounted within the coiled tubing 1002 to withstand a flow of drilling fluid 1010A during a pulsed power drilling operation. A second operation 1072 includes conditioning the electrical power. For example, the input filter 1020 may smooth the electrical power input from the cable 1016, and the boost charger 1025 may increase a voltage of the electrical power. Conditioning of the electrical power that may be may also include altering or controlling one or more electrical parameters associated with the received electrical power including, but not limited to voltage, current, phase, and frequency.

FIG. 11 depicts an example pulse power drilling assembly that is powered based on fluid flow in the wellbore, according to some embodiments. FIG. 11 illustrates an example drilling apparatus 1100. FIG. 11 also depicts a number of example pulse power drilling operations 1170-1178 that can be performed by the example drilling apparatus 1100. The pulse power drilling operations 1170-1178 are described in more detail below (after the description of the different parts of the example drilling apparatus 1100).

The example pulse power drilling apparatus 1100 can include a pulse power drilling assembly (hereinafter "assembly") 1150 positioned in a wellbore 1106 and secured to a length of drill pipe 1102 coupled to a drilling platform 1160 and a derrick 1164. While depicted on the land 1104 as an onshore drilling operation, example embodiments can also be performed as an offshore drilling operation. The assembly 1150 can be configured to further the advancement of the wellbore 1106 using pulse electrical power generated by the assembly 1150 and provided to electrodes 1144 in a controlled manner to emit an electrical discharge through formation material of a subsurface formation along the bottom face of the wellbore 1106 and in the nearby proximity to the electrodes 1144.

As illustrated in FIG. 11, the assembly 1150 includes multiple sub-assemblies, including, in some embodiments, a downhole motor 1116 at a top of the assembly 1150 where the top of the assembly is a face of the assembly 1150 furthest from a drilling face of the assembly 1150 (which contains the electrodes 1144). The downhole motor 1116 is coupled to multiple additional sub-sections or components. The downhole motor 1116 can be any type of device or machine that may convert hydraulic energy into mechanical energy from a flow of fluid. Examples of such a downhole motor may include a turbine, a positive displacement motor (PDM), etc. These additional sub-sections or components may include various combinations of an alternator sub-section or component of the assembly (hereinafter "alternator") 1118, a rectifier 1120, a rectifier controller 1122, a direct current (DC) link 1124, a voltage booster (alternatively referred to as an output power converter) 1126, a voltage boost controller 1128, a pulse power controller 1130, a switch bank 1134 (including one or more switches 1138), one or more primary capacitor(s) 1136, a pulse transformer 1140, one or more secondary capacitors 1142, and the electrodes 1144. While described as a voltage booster, other power converters may be used in place of the voltage booster 1126.

The assembly 1150 can be divided into a generator 1152 and a pulse power section 1154. The generator 1152 can include the downhole motor 1116 and a converter and power conditioner 1199. The converter and power conditioner 1199 can include the alternator 1118, the rectifier 1120, the rectifier controller 1122, the DC link 1124, the voltage booster 1126, and the voltage boost controller 1128. The pulse power section 1154 can include the pulse power controller 1130, the switch bank 1134 (and switch(es) 1138), the one or more primary capacitor(s) 1136, the pulse transformer 1140, the one or more secondary capacitors 1142, and the electrodes 1144. Components can be divided between the generator 1152 and the pulse power section 1154 in other arrangements, and the order of the components can be other than shown.

In some embodiments, the rectifier 1120, the DC link 1124, and the voltage booster 1126 may be referred to as a "power conditioning system", or PCS, and are included in the converter and power conditioner 202. These additional sub-assemblies of the PCS may be electrically coupled to receive the electrical power output generated by the alternator 1118 and to provide further processing of the received electrical power in order to provide a conditioned electrical power output comprising conditioned electrical power. This further processing of the electrical power output received at the PCS may include rectification, voltage boosting, and frequency and/or waveform smoothing or regulating of the received electrical power. In operation, the rectifier controller 1122 may control rectification functions performed by the PCS, while the voltage boost controller 1128 may control voltage boosting functions being performed by the PCS. In some embodiments, a single controller may control both the rectifier 1120 and the voltage booster 1126.

The assembly 1150 may be comprised of multiple sub-sections, with a joint used to couple each of these sub-sections together in a desired arrangement to form the assembly 1150. Field joints 1112A-C can be used to couple the generator 1152 and the pulse power section 1154 to construct the assembly 1150 and to couple the assembly 1150 to the drill pipe 1102. In some embodiments, the assembly 1150 may include one or more additional field joints coupling various components of the assembly 1150 together. Field joints may be places where the assembly 1150 is assembled or disassembled in the field, for example at the drill site. In addition, the assembly 1150 may require one or more joints referred to as shop joints that are configured to allow various sub-sections of the assembly 1150 to be coupled together (for example at an assembly plant or at a factory). For example, various components of the assembly 1150 may be provided by different manufacturers, or assembled at different locations, which require assembly before being shipped to the field.

Regardless of whether a joint in the assembly 1150 is referred to as a field joint or a shop joint, the center flow tubing 1114 extends through any of the components that include the center flow tubing 1114. A joint between separate sections of the center flow tubing 1114 or a hydraulic seal capable of sealing the flow of the drilling fluid within the center flow tubing 1114 may be formed to prevent leaking at the joints.

A flow of drilling fluid (illustrated by the arrow 1110A pointing downward within the drill pipe 1102) can be provided from the drilling platform 1160, and flow to and through the downhole motor 1116, exiting the downhole motor 1116 and flowing on into other sub-sections or components of the assembly 1150, as indicated by the arrow 1110B. For example, the downhole motor 1116 can be a turbine such that the flow of drilling fluid through the device 1116 can cause the downhole motor 1116 to be mechanically rotated. This mechanical rotation can be coupled to the alternator 1118 in order to generate electrical power. The PCS can further process and controllably provide the electrical power to the rest of the downstream assembly 1150. The stored power can then be output from the electrodes 1144 in order to perform the advancement of the wellbore 1106 via periodic electrical discharges.

The drilling fluid can flow through the assembly 1150, as indicated by arrow 1110B, and flow out and away from the electrodes 1144 and back toward the surface to aid in the removal of the debris generated by the breaking up of the formation material at and nearby the electrodes 1144. The fluid flow direction away from the electrodes 1144 is indicated by arrows 1110C and 1110D. In addition, the flow of drilling fluid may provide cooling to one or more devices and to one or more portions of the assembly 1150. In various embodiments, it is not necessary for the assembly 1150 to be rotated as part of the drilling process, but some degree of rotation or oscillations of the assembly 1150 may be provided in various embodiments of drilling processes utilizing the assembly 1150, including internal rotations occurring at the downhole motor 1116, in the alternator sub-section, etc.

The flow of drilling fluid passing through the downhole motor 1116 can continue to flow through one or more sections of a center flow tubing 1114, which thereby provides a flow path for the drilling fluid through one or more sub-sections or components of the assembly 1150 positioned between the downhole motor 1116 and the electrodes 1144, as indicated by the arrow 1110B pointing downward through the cavity of the sections of the center flow tubing 1114. Once arriving at the electrodes 1144, the flow of drilling fluid can be expelled out from one or more ports or nozzles located in or in proximity to the electrodes 1144. After being expelled from the assembly 1150, the drilling fluid can flow back upward toward the surface through an annulus 1108 created between the assembly 1150 and walls of the wellbore 1106.

The center flow tubing 1114 may be located along a central longitudinal axis of the assembly 1150 and may have an overall outside diameter or outer shaped surface that is smaller in cross-section than the inside surface of a tool body 1146 in cross-section. As such, one or more spaces can be created between the center flow tubing 1114 and an inside wall of the tool body 1146. These one or more spaces may be used to house various components, such as components which make up the alternator 1118, the rectifier 1120, the rectifier controller 1122, the DC link 1124, the voltage booster 1126, the voltage boost controller 1128, the sensor 1129, the pulse power controller 1130, the switch bank 1134, the one or more switches 1138, the one or more primary capacitor(s) 1136, the pulse transformer 1140, and the one or more secondary capacitors 1142, as shown in FIG. 11. The sensor 1129 can be located in different locations within the assembly. As depicted in FIG. 11, the sensor 1129 is positioned near the pulse power controller 1130. However, the sensor 1129 can be in any location within the assembly 1150 and may include more than a single sensor (depending on the size and particular sensor measurement). Other components may be included in the spaces created between the center flow tubing 1114 and the inside wall of the tool body 1146.

The center flow tubing 1114 can seal the flow of drilling fluid within the hollow passageways included within the center flow tubing 1114 and at each joint coupling sections of the center flow tubing 1114 together to prevent the drilling fluid from leaking into or otherwise gaining access to these spaces between the center flow tubing 1114 and the inside wall of the tool body 1146. Leakage of the drilling fluid outside the center flow tubing 1114 and within the assembly 1150 may cause damage to the electrical components or other devices located in these spaces and/or may contaminate fluids, such as lubrication oils, contained within these spaces, which may impair or completely impede the operation of the assembly 1150 with respect to drilling operations.

The example pulse power drilling apparatus 1100 can include one or more logging tools 1148. The logging tools 1148 are shown as being located on the drill pipe 1102, above the assembly 1150, but can also be included within the assembly 1150 or joined via shop joint or field joint to assembly 1150. The logging tools 1148 can include one or more logging with drilling (LWD) or measurement while drilling (MWD) tool, including resistivity, gamma-ray, nuclear magnetic resonance (NMR), etc. The logging tools 1148 can include one or more sensors to collect data downhole. For example, the logging tools 1148 can include pressure sensors, flowmeters, etc. The example pulse power drilling apparatus 1100 can also include directional control, such as for geosteering or directional drilling, which can be part of the assembly 1150, the logging tools 1148, or located elsewhere on the drill pipe 1102.

Communication from the pulse power controller 1130 to the voltage boost controller 1128 allows the pulse power controller 1130 to transmit data about and modifications for pulse power drilling to the generator 1152. Similarly, communication from the voltage boost controller 1128 to the pulse power controller 1130 allows the generator 1152 to transmit data about and modifications for pulse power drilling to the pulse power section 1154. The pulse power controller 1130 can control the discharge of the pulse power stored for emissions out from the electrodes 1144 and into the formation, into drilling mud, or into a combination of formation and drilling fluids. The pulse power controller 1130 can measure data about the electrical characteristics of each of the electrical discharges-such as power, current, and voltage emitted by the electrodes 1144. Based on information measured for each discharge, the pulse power controller 1130 can determine information about drilling and about the electrodes 1144, including whether or not the electrodes 1144 are firing into the formation (i.e., drilling) or firing into the formation fluid (i.e., electrodes 1144 are off bottom). The generator 1152 can control the charge rate and charge voltage for each of the multiple pulse power electrical discharges. The PCS, together with the downhole motor 1116 and alternator 1118, can create an electrical charge in the range of 16 kilovolts (kV) which the pulse power controller 1130 delivers to the formation via the electrodes 1144.

When the pulse power controller 1130 can communicate with the generator 1152, the generator 1152 and the alternator 1118 can ramp up and ramp down in response to changes or electrical discharge characteristics detected at the pulse power controller 1130. Because the load on the downhole motor 1116, the alternator 1118, and the generator 1152 is large (due to the high voltage), ramping up and ramping down in response to the needs of the pulse power controller 1130 can protect the generator 1152 and associated components from load stress and can extend the lifetime of components of the pulse power drilling assembly. If the pulse power controller 1130 cannot communicate with the generator 1152, then the generator 1152 may apply a constant charge rate and charge voltage to the electrodes 1144 or otherwise respond slowly to downhole changes—which would be the case if the generator 1152 is controlled by the drilling mud flow rate adjusted at the surface or another surface control mechanism.

In instances where the assembly 1150 is off bottom, electrical power input to the system can be absorbed (at least partially) by drilling fluid, which can be vaporized, boiled off, or destroyed because of the large power load transmitted in the electrical pulses. In instances where the assembly 1150 is not operating correctly, such as when one or more switch experiences a fault or requires a reset, application of high power to the primary and/or secondary capacitors 1136/1142 or the electrodes 1144 can damage circuitry and switches when applied at unexpected or incorrect times. In these and additional cases, communications or messages between the pulse power controller 1130 and the generator 1152 allow the entire assembly to vary charge rates and voltages, along with other adjustments further discussed below. In cases where the pulse power controller 1130 and generator 1152 are autonomous, i.e., not readily in communication with the surface, downhole control of the assembly 1150 can improve pulse power drilling function.

Example pulse power drilling operations 1170-1178 are now described. A first operation 1170 includes generating mechanical energy. For example if the downhole motor 1116 is a turbine, the mechanical energy can be generated by rotation of the turbine caused by the flow of drilling mud being delivered downhole. A second operation 1172 includes converting the mechanical energy into electrical power. For example, the alternator 1118 can convert the mechanical energy being generated by the downhole motor 1116 into electrical power. A third operation 1174 includes conditioning the electrical power. For example, the rectifier 1120 can rectify and smooth the electrical power being output by the alternator 1118 and the voltage booster 1126 can increase a voltage of the electrical power.

A fourth operation 1176 includes storing the conditioned electrical power. The electrical power can be stored in a primary capacitor 1136 ("primary capacitor") of the pulse power section 1154. In some implementations, the electrical power stored in the primary capacitor 1136 may have a variance that is greater than a variance threshold. For example, the variance threshold may be defined in terms of peak to average ratio of the power. For instance, the variance threshold may be a peak to average ratio of 4 or 5 to 1. In some other implementations, the variance threshold may be a different peak to average ratio (such as 3 to 1, 2 to 1, 8 to 1, etc.). The downhole motor 1116 is coupled to output a mechanical energy to a converter and power conditioner 1199. The converter and power conditioner 1199 can include the alternator 1118, the rectifier 1120, the DC link 1124, and the voltage booster 1126. As described above, components of the converter and power conditioner 1199 can convert the mechanical energy into electrical power. The electrical power can be stored in the primary capacitor(s) 1136 while switch(es) in the switch bank 1134 are open. For simplicity, FIG. 1 depicts only one switch in the switch bank 1134. However, the number and configuration of switches can differ.

As further described below, a pulse of electrical discharge can be periodically output from the electrode(s) 1144 to perform pulse power drilling. Switch(es) of the switch bank 1134 can remain open until a sufficient amount of power has been stored in the primary capacitors 1136. After a sufficient amount of power has been stored in the primary capacitors 1136, the switch(es) can be closed to supply power to the pulse transformer 1140 and the secondary capacitors 1142 (through an inductor), which is then emitted from the electrode(s) 1144 as a pulse of electrical discharge into the subsurface formation for pulse power drilling. For example, the switch(es) can be closed when the primary capacitor(s) 1136 storing the energy are fully charged. Alternative or additional criteria can be used to determine when to close the switch(es) (as further described below). Additionally, electrical power can continue to be generated by the flow of drilling mud. This electrical power can be stored in generator capacitors (e.g., DC link capacitors) in order to prevent damage to the downhole motor 1116, the alternator 1118, etc. For example, electrical power can be stored in DC link capacitors of the DC link 1124.

A fifth operation 1178 includes pulsing an electrical discharge into the rock of the subsurface formation. For example, the pulse power controller 1130 can determine whether at least one discharge criteria has been satisfied. The discharge criteria can be a criteria that a defined amount of energy has been stored in the primary capacitor(s) 1136. For example, the discharge criteria can be that the primary capacitor(s) 1136 are fully charged, charged more than a defined percentage of the full storage capacity (e.g., 99%, 95%, 90%, 50%, etc.), etc. Another example criteria can be that a bottom of the drill string is in contact with a bottom of the wellbore. For example, the criteria can be that at least a minimum amount of surface area of the bottom of the drill string in in contact with a bottom of the wellbore. Another example criteria can be that a defined amount of time has elapsed since a prior pulsing of the electrical discharge. This defined amount of time can help ensure that the bottom of the drill string is in contact with a bottom of the wellbore prior to pulsing of the electrical discharge. In response to the discharge criteria being satisfied, the pulse power controller 1130 can cause the primary capacitor(s) 1136 to release the stored energy from the primary capacitor(s) 1136 through the electrode(s) 1144—resulting in the pulse of electrical discharge into the surrounding subsurface formation. This pulsing of the electrical discharge can continue to occur periodically in response to the discharge criteria being satisfied.

Example Operations

Figure 12:
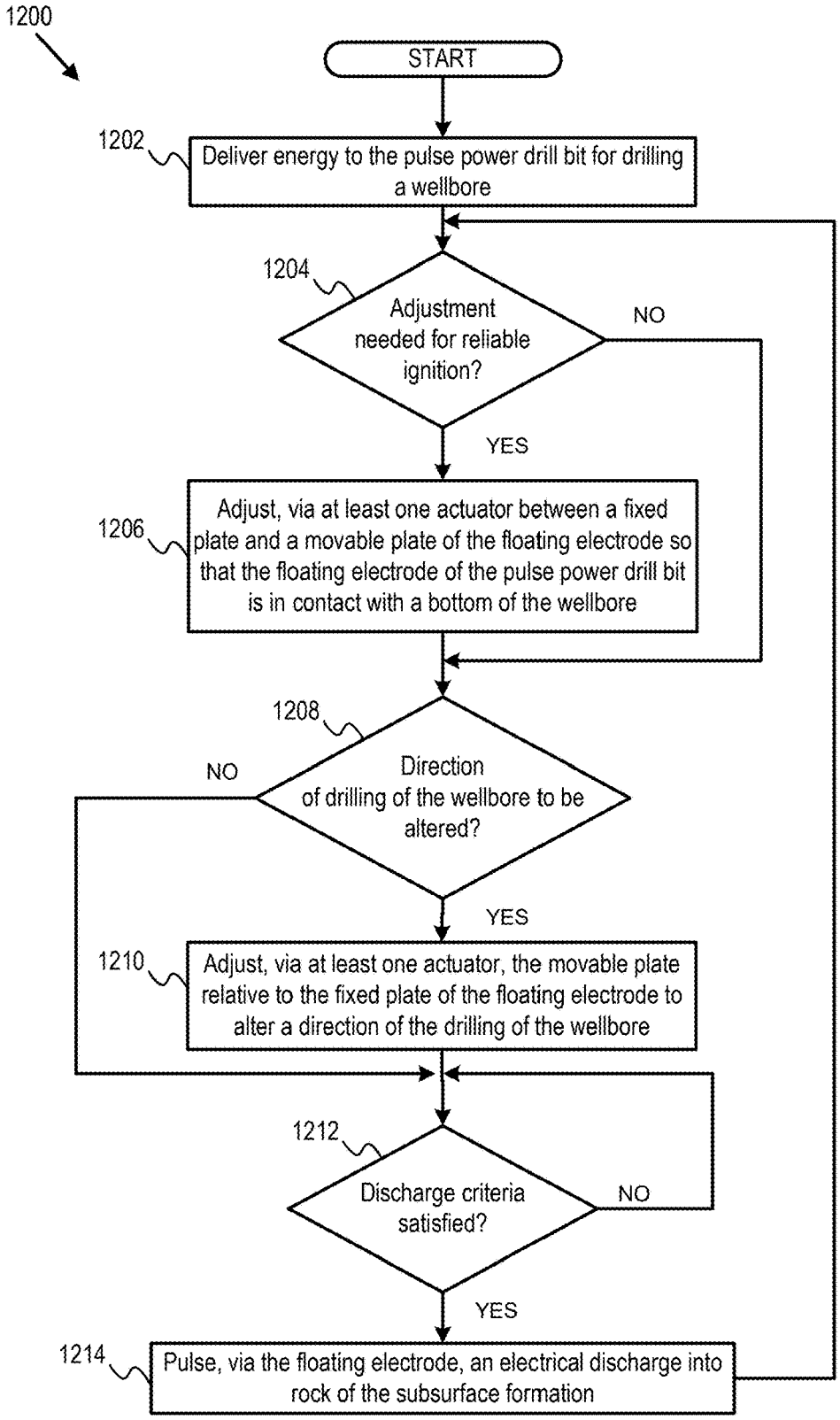
FIG. 12 depicts a flowchart of example operations for pulse power drilling, according to some embodiments.

Example operations for pulse power drilling are now described. in reference to FIG. 12. FIG. 12 depicts a flowchart of example operations for pulse power drilling, according to some embodiments. Operations of a flowchart 1200 can be performed by software, firmware, hardware, or a combination thereof. Operations of the flowchart 1200 are described in reference to the example pulse powered drill bits and example systems described above. However, other systems and components may be used to perform the operations now described. The operations of the flowchart 1200 start at block 1202.

At block 1202, energy is delivered to a pulse power drill bit downhole for drilling a wellbore. For example, with reference to FIG. 10, energy may be delivered via a coiled tubing. In another example, with reference to FIG. 11, energy may be delivered via fluid flow downhole in the wellbore. For example, the drilling mud may be delivered from the drilling platform 1160 at the surface and down the drill pipe 1102 positioned in the wellbore 1106. A pump at the drilling platform 1160 may be used to deliver the drilling mud.

At block 1204, a determination is made of whether an adjustment is needed for reliable ignition so that the pulse is emitted into the subsurface formation to drill the wellbore. For example, with reference to FIG. 9, the PPD feedback measurement system 906 may make this determination based on monitoring whether the drill bit is contact with the bottom of the wellbore. If an adjustment is needed, operations of the flowchart 1200 continue at block 1206. Otherwise, operations of the flowchart 1200 continue at block 1208.

At block 1206, adjustment is made, via at least one actuator between a fixed plate and a movable plate of the floating electrode, so that the floating electrode of the pulse power drill bit is in contact with a bottom of the wellbore. For example, with reference to FIG. 5, the actuators 510-514 may be adjusted to extend or retract the fixed plate 508 so that the fixed plate 508 is in contact with the bottom of the wellbore.

At block 1208, a determination is made of whether a direction of the drilling of the wellbore is to be altered. This determination can be based on drilling data for the wellbore being drilled and may be made at the surface and/or downhole. For example, drilling of the wellbore can be altered based on operational parameters. Operational parameters may include any adjustable parameter that may influence drilling. For example, drilling may be altered based on a rate of penetration (ROP) for the drilling operation. Alternatively or in addition, drilling may be altered based on a property of a drilling fluid. For example, drilling may be altered based on the presence of cuttings in a drilling fluid. In some embodiments, drilling data may include directional survey data and determining whether drilling of the wellbore is to be altered may be based on directional survey data. For example, directional survey data may indicate that drilling of the wellbore is proceeding in an undesired direction and it may be determined that drilling is to be altered in order to advance the wellbore in a desired direction. Optionally, directional survey data may be compared to a wellbore trajectory model for the drilling operation to determine whether the trajectory of the wellbore being drilled is desirable. Alternatively or in addition, directional survey data may be used to update a wellbore trajectory model and altering the drilling may be based on the updated wellbore trajectory model.

In some embodiments, determining whether drilling is to be altered may be based on optimizing an aspect of the drilling operation. For instance, drilling of the wellbore may be altered to maximize recovery of hydrocarbons from the subsurface formation. In some embodiments, data collected during drilling may be used to evaluate the formation through which the wellbore is being drilled. For example, a computer can execute instructions to perform a formation evaluation of the formations being drilled in real time to make this determination. Alternatively or in addition, determining whether drilling is to be altered may be based on drilling data from drilling of a previous wellbore into a subsurface formation that is assumed to be similar to the subsurface formation into which the current wellbore is being drilled. For example, the previous wellbore may be proximate to the current wellbore (i.e., in the same basin). Drilling data from a previous wellbore may be used to identify which layers of the formation include recoverable hydrocarbons and their associated depths. Thus, direction of drilling of the current wellbore may be altered so that the wellbore is drilled through these layers identified as having recoverable hydrocarbons. If a direction of the drilling of the wellbore needs to be altered, operations of the flowchart 1200 continue at block 1210. Otherwise, operations of the flowchart 1200 continue at block 1212.

At block 1210, a direction of the drilling of the wellbore is altered. For example, with reference to FIG. 3, the actuators 310-314 may be adjusted to tip the drill bit—to alter a direction of the drilling. In another example, with reference to FIG. 4, the actuators 410-414 may be adjusted to tilt the drill bit—to alter a direction of the drilling.

At block 1212, a determination is made of whether a discharge criteria is satisfied. For example, with reference to FIG. 9, the pulse power drilling processor 914 may determine whether one or more discharge criteria is satisfied. For example, with reference to FIG. 11, the discharge criteria can be a criteria that a defined amount of energy has been stored in the primary capacitor(s) 1136. An example can be that the primary capacitor(s) 1136 are fully charged, more than a defined percent (e.g., 99%, 95%, 90%, 50%, etc.), etc. Another example criteria can be that a bottom of the drill string is in contact with a bottom of the wellbore. For example, the criteria can be that at least a minimum amount of surface area of the bottom of the drill string in in contact with a bottom of the wellbore. Another example criteria can be that a defined amount of time has elapsed since a prior pulsing of the electrical discharge. This defined amount of time can help ensure that the bottom of the drill string is in contact with a bottom of the wellbore prior to pulsing of the electrical discharge.

At block 1214, an electrical discharge is pulsed, via the floating electrode, into rock of the subsurface formation. For example, with reference to FIG. 11, in response to the discharge criteria being satisfied, the pulse power controller 1130 may cause the primary capacitor(s) 1136 to release the stored energy from the primary capacitor(s) 1136 and through the floating electrode—resulting in the pulse of electrical discharge into the surrounding subsurface formation. This pulsing of the electrical discharge can continue to occur periodically in response to the discharge criteria being satisfied. Accordingly, operations of the flowchart 1200 may return to block 1204 to determine whether an adjustment is needed for reliable ignition so that the pulse is emitted into the subsurface formation to drill the wellbore.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

While the aspects of the disclosure are described with reference to various implementations and exploitations, it will be understood that these aspects are illustrative and that the scope of the claims is not limited to them. In general, techniques for pulse power drilling as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Implementations

Implementation #1: An electro-crushing drill bit to drill a wellbore, the electro-crushing drill bit comprising: a bit body; a ground structure coupled to the bit body; and at least one electrode coupled to a power source and the bit body, the at least one electrode positioned within the ground structure, wherein the at least one electrode comprises, a fixed plate; and a movable plate that is movable relative to the fixed plate.

Implementation #2: The electro-crushing drill bit of Implementation #1, wherein the power source is configured to supply a pulse of power to the at least one electrode for emission into a subsurface formation into which the wellbore is formed to drill the wellbore.

Implementation #3: The electro-crushing drill bit of any one of Implementations #1-2, wherein the at least one electrode comprises at least one actuator coupled to the movable plate to move the movable plate relative to the fixed plate.

Implementation #4: The electro-crushing drill bit of any one of Implementations #1-3, wherein the at least three actuators that are approximately equidistance apart and positioned symmetrically around the movable plate.

Implementation #5: The electro-crushing drill bit of any one of Implementations #1-4, wherein a directional controller is communicatively coupled to the at least one actuator, wherein the directional controller is to control the at least one actuator.

Implementation #6: The electro-crushing drill bit of any one of Implementations #1-5, wherein the directional controller is to change a direction of the drilling of the wellbore based on controlling movement of the movable plate relative to the fixed plate caused by motion of the at least one actuator.

Implementation #7: The electro-crushing drill bit of any one of Implementations #1-6, wherein the movement of the movable plate comprises a tilt of the movable plate.

Implementation #8: The electro-crushing drill bit of any one of Implementations #1-7, wherein the movement of the movable plate comprises a tip of the movable plate.

Implementation #9: The electro-crushing drill bit of any one of Implementations #1-8, wherein the directional controller is to ignite emission of current based on controlling movement of the movable plate relative to the fixed plate caused by motion of the at least one actuator.

Implementation #10: The electro-crushing drill bit of any one of Implementations #1-9, wherein the movement of the movable plate comprises at least one of an extension or retraction of the movable plate.

Implementation #11: The electro-crushing drill bit of any one of Implementations #1-10, wherein at least one ball joint is to couple the at least one actuator to the movable plate.

Implementation #12: The electro-crushing drill bit of any one of Implementations #1-11, wherein the ground structure comprises a ground ring.

Implementation #13: The electro-crushing drill bit of any one of Implementations #1-12, wherein the at least one actuator is a linear actuator of a hydraulic or a piezoelectric or any other type of actuator.

Implementation #14: A downhole drilling system to drill a wellbore, the downhole drilling system comprising: a drill string; a power source; and a drill bit coupled to the drill string and the power source, the drill bit comprising, a bit body; a ground structure coupled to the bit body; and an electrode coupled to a power source and the bit body, the electrode positioned within the ground structure, wherein the at least one electrode comprises, a fixed plate; a movable plate; and at least one actuator coupled to the movable plate to move the movable plate relative to the fixed plate.

Implementation #15: The downhole drilling system of Implementation #14, wherein the power source is configured to supply a pulse of power to the at least one electrode for emission into a subsurface formation into which the wellbore is formed to drill the wellbore.

Implementation #16: The downhole drilling system of any one of Implementations #14-15, wherein the at least one electrode comprises at least one actuator coupled to the movable plate to move the movable plate relative to the fixed plate.

Implementation #17: The downhole drilling system of any one of Implementations #14-16 wherein the at least three actuators that are approximately equidistance apart and positioned around the movable plate.

Implementation #18: The downhole drilling system of any one of Implementations #14-17, wherein a directional controller is communicatively coupled to the at least one actuator, wherein the directional controller is to control the at least one actuator.

Implementation #19: The downhole drilling system of any one of Implementations #14-18, wherein the directional controller is to change a direction of the drilling of the wellbore based on controlling movement of the movable plate relative to the fixed plate caused by motion of the at least one actuator, wherein the movement of the movable plate comprises at least one of a tilt or a tip of the movable plate.

Implementation #20: The downhole drilling system of any one of Implementations #14-19, wherein the directional controller is to ignite emission of current based on controlling movement of the movable plate relative to the fixed plate caused by motion of the at least one actuator, wherein the movement of the movable plate comprises at least one of an extension or retraction of the movable plate.

Implementation #21: A method for performing directional pulse power drilling, the method comprising: drilling, with a pulsed power drill bit, of a wellbore into a subsurface formation using pulse power, wherein the pulsed power drill bit comprise an electrode positioned within a ground structure, wherein the electrode comprises a fixed plate, a movable plate and at least one actuator, wherein the drilling comprises, generating, by an electrical source, an electrical energy; modifying a direction of the drilling of the wellbore, wherein modifying the direction comprises, changing, using the at least one actuator, a position of a movable plate relative to a fixed plate of the electrode; and periodically discharging the electrical energy through the electrode and into the subsurface formation.

Implementation #22: The method of Implementation #21, wherein the drilling comprises extending, using the at least one actuator, the movable plate to place the electrode into contact with a bottom of the wellbore prior to periodically discharging.

Implementation #23: The method of any one of Implementations #21-22, wherein the at least one actuator comprises three actuators that are approximately equidistance apart and positioned around the movable plate.

The invention claimed is:

1. An electro-crushing drill bit to drill a wellbore, the electro-crushing drill bit comprising:

a bit body;

a ground structure coupled to the bit body; and at least one electrode coupled to a power source and the bit body, the at least one electrode positioned within the ground structure, wherein the at least one electrode comprises, a fixed plate;

a movable plate that is movable relative to the fixed plate; and a plurality of actuators coupled to the movable plate that are positioned approximately equidistance apart and symmetrically around the movable plate.

2. The electro-crushing drill bit of claim 1, wherein the power source is configured to supply a pulse of power to the at least one electrode for emission into a subsurface formation into which the wellbore is formed to drill the wellbore.

3. The electro-crushing drill bit of claim 1, wherein the plurality of actuators comprises at least three actuators.

4. The electro-crushing drill bit of claim 1, wherein a directional controller is communicatively coupled to the plurality of actuators, wherein the directional controller is to control the plurality of actuators.

5. The electro-crushing drill bit of claim 4, wherein the directional controller is configured to change a direction of the drilling of the wellbore based on controlling movement of the movable plate relative to the fixed plate caused by motion of the plurality of actuators.

6. The electro-crushing drill bit of claim 5, wherein the directional controller is configured to tilt the movable plate.

7. The electro-crushing drill bit of claim 5, wherein the directional controller is configured to tip the movable plate.

8. The electro-crushing drill bit of claim 4, wherein the directional controller is configured to ignite emission of current based on controlling movement of the movable plate relative to the fixed plate caused by motion of the plurality of actuators.

9. The electro-crushing drill bit of claim 8, wherein the movement of the movable plate comprises at least one of an extension or retraction of the movable plate.

10. The electro-crushing drill bit of claim 1, wherein at least one ball joint is to couple the plurality of actuators to the movable plate.

11. The electro-crushing drill bit of claim 1, wherein the ground structure comprises a ground ring.

12. The electro-crushing drill bit of claim 1, wherein the plurality of actuators comprises linear actuators of a hydraulic, a magnetostrictive, or a piezoelectric.

13. A downhole drilling system to drill a wellbore, the downhole drilling system comprising:

a drill string;

a power source; and a drill bit coupled to the drill string and the power source, the drill bit comprising, a bit body;

a ground structure coupled to the bit body; and an electrode coupled to a power source and the bit body, the electrode positioned within the ground structure, wherein the electrode comprises, a fixed plate;

a movable plate; and a plurality of actuators coupled to the movable plate to move the movable plate relative to the fixed plate, wherein the plurality of actuators are positioned approximately equidistance apart and symmetrically around the movable plate.

14. The downhole drilling system of claim 13, wherein the power source is configured to supply a pulse of power to the electrode for emission into a subsurface formation into which the wellbore is formed to drill the wellbore.

15. The downhole drilling system of claim 13 wherein the plurality of actuators comprises at least three actuators.

16. The downhole drilling system of claim 15, wherein a directional controller is communicatively coupled to the at least one actuator, wherein the directional controller is to control the at least one actuator.

17. The downhole drilling system of claim 15, wherein the directional controller is configured to change a direction of the drilling of the wellbore based on controlling movement of the movable plate relative to the fixed plate caused by motion of the plurality of actuators, wherein the movement of the movable plate comprises at least one of a tilt or a tip of the movable plate.

18. The downhole drilling system of claim 15, wherein the directional controller is configured to ignite emission of current based on controlling movement of the movable plate relative to the fixed plate caused by motion of the plurality of actuators, wherein the movement of the movable plate comprises at least one of an extension or retraction of the movable plate.

19. A method for performing directional pulse power drilling, the method comprising:

drilling, with a pulsed power drill bit, of a wellbore into a subsurface formation using pulse power, wherein the pulsed power drill bit comprise an electrode positioned within a ground structure, wherein the electrode comprises a fixed plate, a movable plate and a plurality of actuators that are positioned approximately equidistance apart and around the movable plate, wherein the drilling comprises, generating, by an electrical source, an electrical energy;

modifying a direction of the drilling of the wellbore, wherein modifying the direction comprises, changing, using the plurality of actuators, a position of a movable plate relative to a fixed plate of the electrode; and periodically discharging the electrical energy through the electrode and into the subsurface formation.

20. The method of claim 19, wherein the drilling comprises extending, using the plurality of actuators, the movable plate to place the electrode into contact with a bottom of the wellbore prior to periodically discharging.

21. The method of claim 19, wherein the plurality of actuators comprises at least three actuators.

* * * * *